US010246809B2

(12) United States Patent
Kim et al.

(10) Patent No.: US 10,246,809 B2
(45) Date of Patent: Apr. 2, 2019

(54) WASHING MACHINE AND METHOD OF CONTROLLING THE SAME USING AN AC MOTOR

(71) Applicant: Samsung Electronics Co., Ltd, Suwon-si (KR)

(72) Inventors: Hyun Oh Kim, Suwon-si (KR); Jun Hyun Park, Osan-si (KR); Sung Mo Lee, Gunpo-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 512 days.

(21) Appl. No.: 15/011,236

(22) Filed: Jan. 29, 2016

(65) Prior Publication Data

US 2016/0251794 A1 Sep. 1, 2016

(30) Foreign Application Priority Data

Jan. 30, 2015 (KR) ..... 10-2015-0015343

(51) Int. Cl.

| | |
|---|---|
| ***D06F 37/30*** | (2006.01) |
| ***D06F 35/00*** | (2006.01) |
| ***D06F 33/02*** | (2006.01) |

(52) U.S. Cl.

CPC ..... *D06F 37/304* (2013.01); *D06F 33/02* (2013.01); *D06F 35/005* (2013.01); *D06F 2202/065* (2013.01); *D06F 2204/065* (2013.01); *D06F 2232/08* (2013.01)

(58) Field of Classification Search

None

See application file for complete search history.

(56) References Cited

U.S. PATENT DOCUMENTS 8,035,332 B2 * 10/2011 Filippa ..... D06F 33/02 318/757

* cited by examiner

*Primary Examiner* — Rita P Adhlakha

(57) ABSTRACT

A washing machine includes an alternating current (AC) motor which generates torque, a clutch assembly which selectively transfers the torque to a rotating tub and a pulsator, a speed detector which detects a rotary speed of the clutch assembly, and a controller configured to repetitively perform operating and stopping the operating of the AC motor based on a predetermined target speed and the rotary speed of the clutch assembly in a spin-drying operation. The controller gradually increases the torque of the AC motor while operating the AC motor.

20 Claims, 30 Drawing Sheets

WASHING MACHINE AND METHOD OF CONTROLLING THE SAME USING AN AC MOTOR

CROSS-REFERENCE TO RELATED APPLICATION AND CLAIM OF PRIORITY

The present application is related to and claims the benefit of Korean Patent Application No. 10-2015-0015343, filed on Jan. 30, 2015 in the Korean Intellectual Property Office, the disclosure of which is incorporated herein by reference.

TECHNICAL FIELD

Embodiments of the present disclosure relate to a washing machine and a method of controlling the same, and more particularly, to a washing machine which includes an alternating current (AC) motor and a method of controlling the washing machine.

BACKGROUND

Generally, washing machines are apparatuses which wash laundry using a frictional force between the laundry and water and can be classified into front-loading type washing machines and top-loading type washing machines.

In front-loading type washing machines, washing is performed using a drop of laundry while a rotating tub which accommodates the laundry rotates. In top-loading type washing machines, a rotating tub in which laundry is accommodated and a pulsator which generates a water current at a bottom of the rotating tub are provided together and washing is performed using the water current generated by the pulsator.

Also, in all front-loading type washing machines and top-loading type washing machines, laundry is spin-dried using a centrifugal force generated by rotation of a rotating tub.

As described above, washing machines operate using rotation of a rotating tub or a pulsator and generally use a motor as a device for providing torque to the rotating tub or pulsator.

As described above, motors generally used in washing machines can be classified into control type motors, so-called servo motors, which precisely control a rotary speed of a motor and a non-control type motors which do not control a rotary speed of a motor.

Control type motors each include a speed sensor which detects a rotary speed of a motor and a current sensor which detects a driving current of the motor and precisely control the driving current depending on the detected rotary speed of the motor. Control type motors described above can each precisely control the rotary speed of the motor regardless of load.

On the contrary, in general, non-control type motors each merely control rotation of a motor through a turn-on time in which power is supplied to the motor and a turn-off time in which power supply to the motor is cut off. Non-control type motors described above are relatively low-priced.

When a washing machine includes a non-control type motor, it is difficult to precisely a rotary speed of the motor. Thus, a resonance phenomenon can continuously occur during a spin-drying operation. Here, the resonance phenomenon means a phenomenon in which a vibration frequency of a rotating tub coincides with a rotation frequency caused by the motor in the spin-drying operation and thus a rotating tub violently vibrates.

In general washing machines using a non-control type motor, since rotation of a rotating tub is controlled only using a turn-on time and a turn-off time of a motor, it is difficult for a rotary speed of the rotating tub to be deviated from a resonance speed of the rotating tub.

SUMMARY

To address the above-discussed deficiencies, it is a primary object to provide, for use in a washing machine which includes a non-control type motor while minimizing a resonance phenomenon during a spin-drying operation.

It is another aspect of the present disclosure to provide a washing machine which includes a clutch assembly while minimizing noise and vibration which occur while a driving motor operates.

It is still another aspect of the present disclosure to provide a washing machine which includes a speed detector while detecting a failure of the speed detector.

Additional aspects of the disclosure will be set forth in part in the description which follows and, in part, will be obvious from the description, or can be learned by practice of the disclosure.

In accordance with one aspect of the present disclosure, a washing machine includes an alternating current (AC) motor which generates torque, a clutch assembly which selectively transfers the torque to a rotating tub and a pulsator, a speed detector which detects a rotary speed of the clutch assembly, and a controller which repetitively performs operating and stopping the operating of the AC motor based on a predetermined target speed and the rotary speed of the clutch assembly during a spin-drying operation. Here, the controller gradually increases the torque of the AC motor while operating the AC motor.

The controller can control a phase angle of AC power supplied from an external power supply and can supply the AC power controlled in phase angle to the AC motor while operating the AC motor.

The controller can supply at least a part of one cycle of an AC current supplied from the external power supply to the AC motor while operating the AC motor.

The washing machine can further include a driving switch unit which conducts or cuts off the power supplied from the external power supply to the AC motor.

The controller can turn on the driving switch unit for a conduction time in one cycle of the AC power supplied from the external power supply while operating the AC motor.

The controller can gradually increase the conduction time while operating the AC motor.

The controller can stop the operating of the AC motor when the rotary speed is greater than a sum of the target speed and an allowable error while operating the AC motor.

The controller can begin the operating of the AC motor when the rotary speed is smaller than a difference between the target speed and an allowable error while stopping the operating of the AC motor.

The target speed can vary according to a time in which the spin-drying operation is performed.

The speed detector can include a position indicating member which rotates together with the clutch assembly and a speed sensor which detects the position indicating member and outputs an electric signal corresponding to whether the position indicating member is detected.

The controller can warn a user of a failure of the speed sensor when the rotary speed is "0" after the AC motor is operated.

The controller can warn a user of omission of the position indicating member when the rotary speed is smaller than a predetermined reference speed after the AC motor is fully operated.

In accordance with another aspect of the present disclosure, a method of controlling a washing machine includes operating an AC motor which generates torque during a spin-drying operation, detecting a rotary speed of a clutch assembly which transfers the torque to a rotating tub and a pulsator, and repetitively performing operating and stopping the operating of the AC motor based on a predetermined target speed and the rotary speed of the clutch assembly during the spin-drying operation. Here, the operating of the AC motor includes gradually increasing the torque of the AC motor.

The gradually increasing of the torque of the AC motor can include controlling a phase angle of AC power supplied from an external power supply and supplying the AC power controlled in phase angle to the AC motor.

The supplying of the AC power controlled in phase angle to the AC motor can include supplying at least a part of one cycle of an AC current supplied from the external power supply to the AC motor.

The repetitively performing the operating and stopping of the operating of the AC motor can include stopping the operating of the AC motor when the rotary speed is greater than a sum of the target speed and an allowable error while operating the AC motor.

The repetitively performing the operating and stopping of the operating of the AC motor can include beginning the operating of the AC motor when the rotary speed is smaller than a difference between the target speed and an allowable error while stopping the operating of the AC motor.

The target speed may vary according to a time in which the spin-drying operation is performed.

The method may further include warning a user of a failure of a speed sensor which detects the rotary speed of the clutch assembly when the rotary speed is "0" after the AC motor is operated.

The method may further include warning a user of a failure of a speed sensor which detects the rotary speed of the clutch assembly when the rotary speed is smaller than a predetermined reference speed after the AC motor is fully operated.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 29, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged washing machine technologies. Hereinafter, one embodiment of the present disclosure will be described in detail with reference to the attached drawings.

Figure 1:
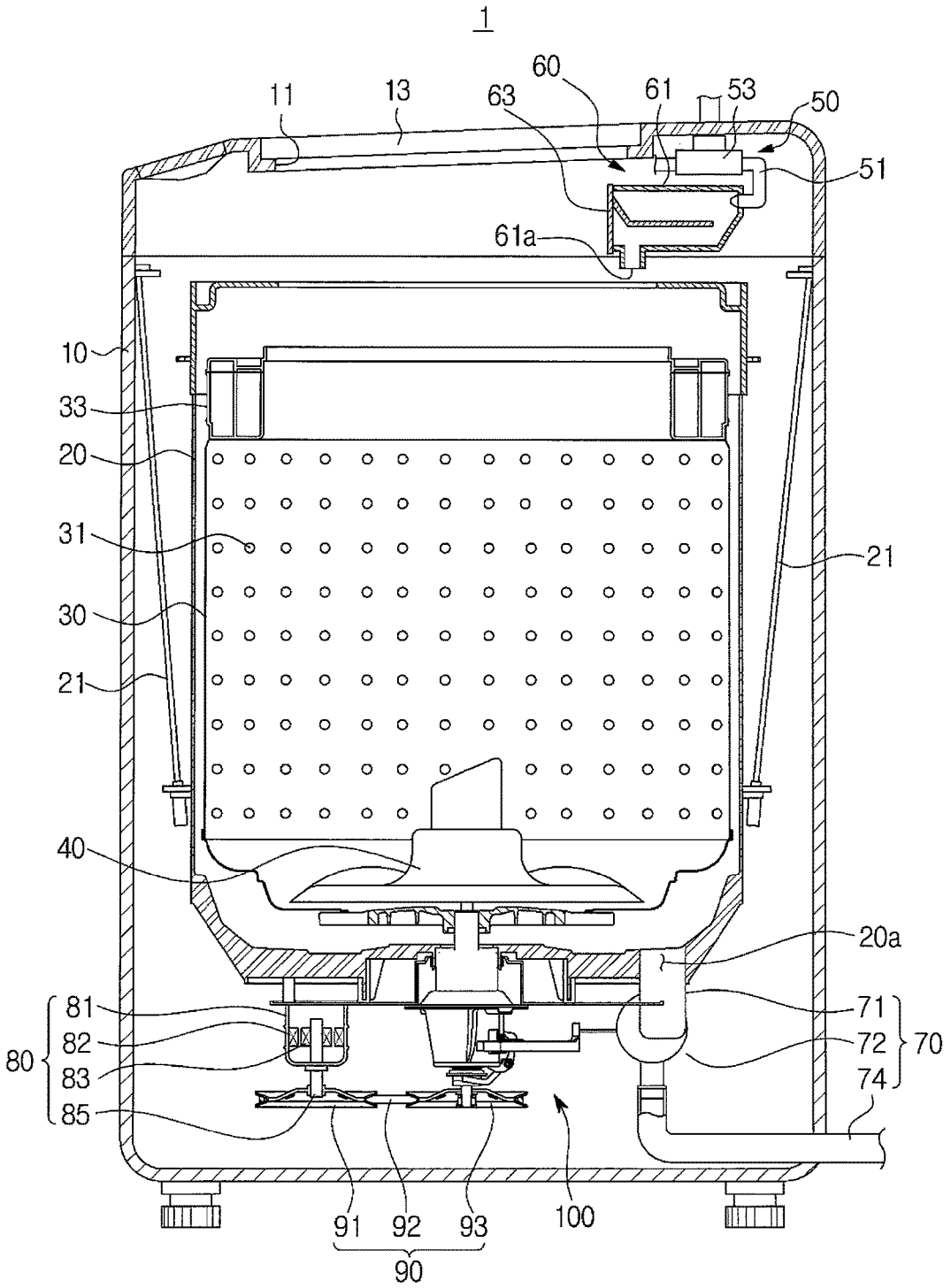
FIG. 1 illustrates an external shape of a washing machine in accordance with one embodiment of the present disclosure.
Figure 2:
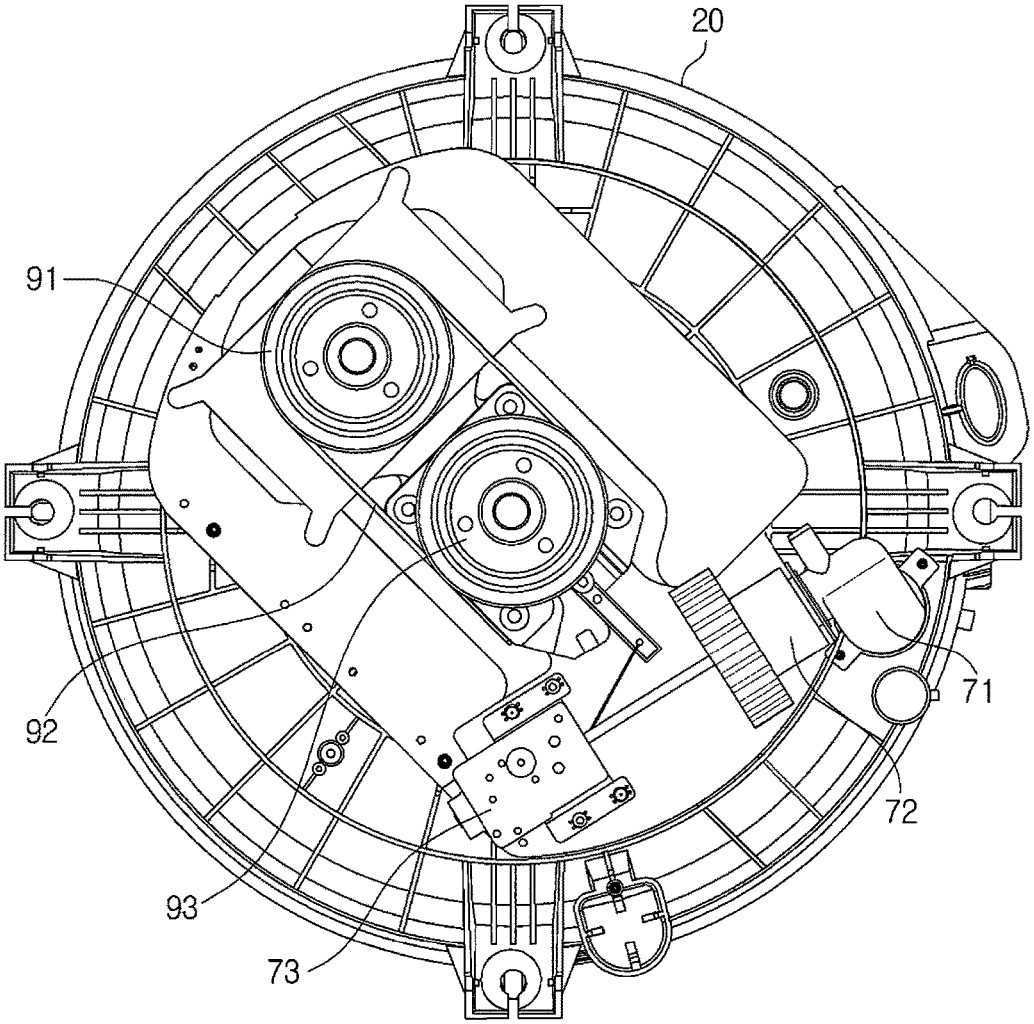
FIG. 2 illustrates a bottom of the washing machine in accordance with one embodiment of the present disclosure.

FIG. 1 illustrates an external shape of a washing machine 1 in accordance with one embodiment of the present disclosure. FIG. 2 illustrates a bottom of the washing machine 1 in accordance with one embodiment of the present disclosure.

Referring to FIGS. 1 and 2, the washing machine 1 includes a cabinet 10 which forms the external shape, a tub 20 which contains water, a rotating tub 30 rotatably disposed in the tub 20, a pulsator 40 which generates a water current in the rotating tub 30, a water supply unit 50 which supplies water, a detergent supply unit 60 which supplies a detergent, a drainage unit 70 which discharges water, a driving motor 80 which generates torque, a pulley unit 90 which transfers the torque of the driving motor 80 to a clutch assembly 100, and the clutch assembly 100 which selectively transfers the torque to the rotating tub 30 and the pulsator 40.

An inlet 11 is formed in a top of the cabinet 10 to allow laundry to be inserted into the rotating tub 30 and is opened and closed by a door 13 installed above the cabinet 10.

The tub 20 can be formed in a cylindrical shape with an open top and can contain water for washing therein. Also, a drain 20*a* for discharging the water contained in the tub 20 can be provided at a bottom side of the tub 20.

The tub 20 is supported by a damper 21 while being held by the cabinet 10. The damper 21 damps vibrations which occur at the tub 20 while the rotating tub 30 or the pulsator 40 rotates and is provided between an external surface of the tub 20 and an internal surface of the cabinet 10.

The rotating tub 30 can be formed in a cylindrical shape with an open top to allow the laundry to be inserted therein and is rotatably provided in the tub 20.

The rotating tub 30 contains the laundry and water therein. A plurality of water-discharge holes 31 are formed in a lateral side of the rotating tub 30 to interconnect an internal space of the rotating tub 30 with an internal space of the tub 20.

A balancer 33 which offsets an unbalanced load which occurs at the rotating tub 30 while the rotating tub 30 rotates is mounted on a top of the rotating tub 30 and allows the rotating tub 30 to stably rotate.

The pulsator 40 can be provided at a bottom inside the rotating tub 30 and generates the water current while rotating clockwise or counterclockwise. Due to the water current generated by the pulsator 40, the laundry in the rotating tub 30 is stirred together with the water. Washing is performed by friction between the laundry and water.

The water supply unit 50 is provided above the tub 20 and supplies water into the tub 20 from an external water supply source (not shown).

The water supply unit 50 includes a water supply pipe 51 which guides the water to the tub 20 from the external water supply source and a water supply valve 53 provided on the water supply pipe 51 to open and close the water supply pipe 51.

One end of the water supply pipe 51 is connected to the detergent supply unit 60 which will be described below. The water supplied through the water supply pipe 51 passes through the detergent supply unit 60 and is supplied to the tub 20.

The detergent supply unit 60 includes a detergent box 63 which contains the detergent and a detergent box case 61 which accommodates the detergent box 63.

The detergent box case 61 is provided to be fixed to the cabinet 10 and is connected to the one end of the water supply pipe 51 described above. Also, an outlet 61*a* for discharging the water which passes through the detergent supply unit 60 to the tub 20 is provided at a bottom side of the detergent box case 61.

The detergent box 63 is detachably mounted in the detergent box case 61 in such a way that a user can withdraw the detergent box 63 from the detergent box case 61 to insert the detergent into the detergent box 63.

The detergent box 63 is connected to the water supply pipe 51 to allow the water supplied through the water supply pipe 51 to be mixed with the detergent contained in the detergent box 63. As described above, the water supplied by the water supply unit 50 is mixed with the detergent contained in the detergent box 63 while passing through the detergent box 63 and the water mixed with the detergent is supplied to the tub 20 through the outlet 61*a* provided at the bottom side of the detergent box case 61.

The drainage unit 70 can be provided below the tub 20 and discharges the water contained in the tub 20 from the cabinet 10.

The drainage unit 70 includes a first drainpipe 71 which guides the water contained in the tub 20 outward from the tub 20, a drain valve 72 which opens and closes the first drainpipe 71, a drainage motor 73 which drives the drain valve 72, and a second drainpipe 74 which guides the water which passes through the drain valve 72 outward from the cabinet 10.

One end of the first drainpipe 71 is connected to the drain 20*a* provided in the bottom side of the tub 20 and another end thereof is connected to the drain valve 72.

The drain valve 72 is provided at the one side of the first drainpipe 71 and opens and closes the first drainpipe 71. When the drain valve 72 is opened, the water in the tub 20 can be discharged outward through the first drainpipe 71 and the second drainpipe 74.

The drain valve 72 can receive a driving force for opening and closing the drain valve 72 from the drainage motor 73.

The drainage motor 73 drives opening and closing of the drain valve 72 through a link wire 73*a*. In detail, when the drainage motor 73 is operated, the drain valve 72 can be opened and the water in the tub 20 can be discharged. When the drainage motor 73 is not operated, the drain valve 72 can be closed.

Also, the drainage motor 73 can switch an operation mode of the clutch assembly 100 through the link wire 73*a*. As will be described below, the clutch assembly 100 can operate in a washing mode of transferring torque to the pulsator 40 and a spin-drying mode of transferring the torque to the rotating tub 30 and the pulsator 40.

For example, the clutch assembly 100 can operate in the spin-drying mode when the drainage motor 73 is operated and can operate the clutch assembly 100 in the washing mode when the drainage motor 73 is not operated.

One end of the second drainpipe 74 is connected to the second drainpipe 74 and another end thereof extends from the cabinet 10 to guide the water discharged through the first drainpipe 71 to the outside of the cabinet 10.

The driving motor 80 includes a motor housing 81 which forms an external shape, a stator 82 which generates a rotating magnetic field, a rotor 83 which rotates due to the rotating magnetic field, and a driving shaft 85 coupled with the rotor 83 to rotate together with the rotor 83. The driving motor 80 generates torque which rotates the rotating tub 30 and the pulsator 40.

The stator 82 can be fixed in the motor housing 81 and can have a cylindrical shape with a hollow. Also, the stator 82 includes a coil which generates the rotating magnetic field when being charged with electric current and the coil is disposed along an inner circumferential surface of the stator 82.

The rotor 83 is rotatably provided in the stator 82 and rotates due to interaction with the rotating magnetic field generated by the stator 82.

The driving shaft 84 is coupled with the rotor 83 to rotate together with the rotor 83 and transfers the torque of the rotor 83 to the pulley unit 90 which will be described below.

The driving motor 80 described above can employ an induction motor (IM) in which an induced current is generated at the rotor 83 due to the rotating magnetic field generated by the stator 82 and the rotor 83 rotates due to interaction between a magnetic field caused by the induced current and the rotating magnetic field generated by the stator 82.

However, the driving motor 80 included in the washing machine 1 is not limited to the IM. For example, the driving motor 80 can employ a synchronous motor (SM) in which the rotor 83 includes a permanent magnet which generates a magnetic field.

Hereinafter, it is assumed that the driving motor 80 included in the washing machine 1 employs the IM.

The pulley unit 90 includes a driving pulley 91 which receives the torque from the driving motor 80, a driven pulley 93 which transfers the torque to the clutch assembly 100, and a pulley belt 92 which transfers the torque of the driving pulley 91 to the driven pulley 93. Here, the driving pulley 91 is connected to the driving shaft 85 of the driving motor 80 and the driven pulley 93 is connected to a driven shaft 140 of the clutch assembly 100.

To briefly describe a process of transferring the torque, the driving motor 80 generates the torque using alternating current (AC) power supplied from an external power supply and transfers the generated torque to the pulley unit 90. Also, the pulley unit 90 transfers the torque transferred from the driving motor 80 to the clutch assembly 100 through the pulley belt 92.

As described above, since the torque generated by the driving motor 80 is transferred to the clutch assembly 100 through the pulley unit 90, a rotary speed of the driving motor 80 and a rotary speed of the clutch assembly 100 can differ from each other. For example, when a diameter of the driving pulley 91 connected to the driving motor 80 is smaller than a diameter of the driven pulley 93 connected to the clutch assembly 100, the torque of the driving motor 80 can be transferred to the clutch assembly 100 while being reduced in speed by the pulley unit 90.

The clutch assembly 100 selectively transfers the torque received from the pulley unit 90 to the rotating tub 30 and the pulsator 40. In detail, the clutch assembly 100 transfers the torque received from the pulley unit 90 to the pulsator 40 while reducing the torque in speed in a washing operation or a rinsing operation and transfers the torque received from the pulley unit 90 to the rotating tub 30 and the pulsator 40 as it is in a spin-drying operation. Accordingly, in the spin-drying operation, the rotary speed of the clutch assembly 100 and the rotary speed of the rotating tub 30 are identical.

The clutch assembly 100 will be described below in more detail.

Figure 3:
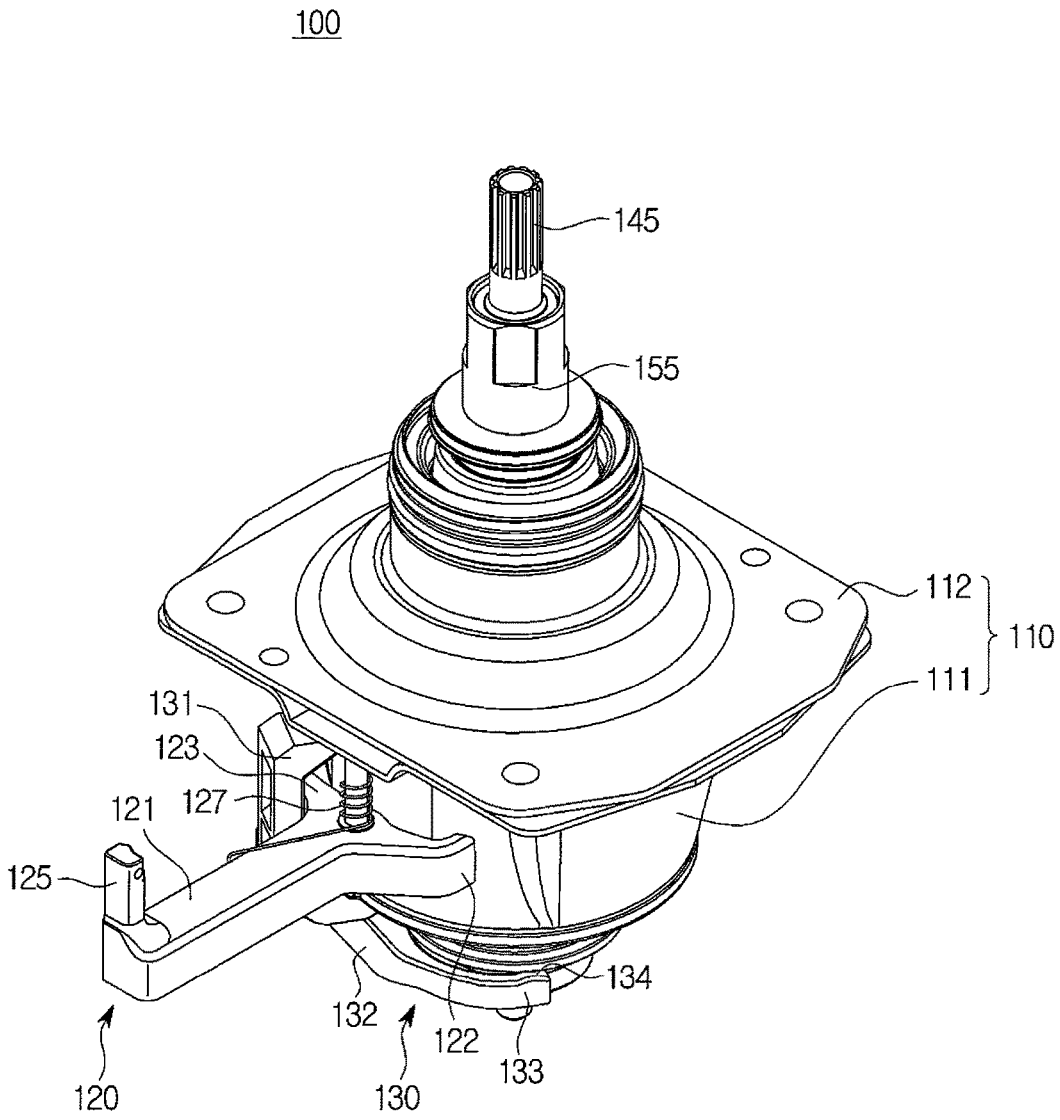
FIG. 3 illustrates a clutch assembly included in the washing machine in accordance with one embodiment of the present disclosure.
Figure 4:
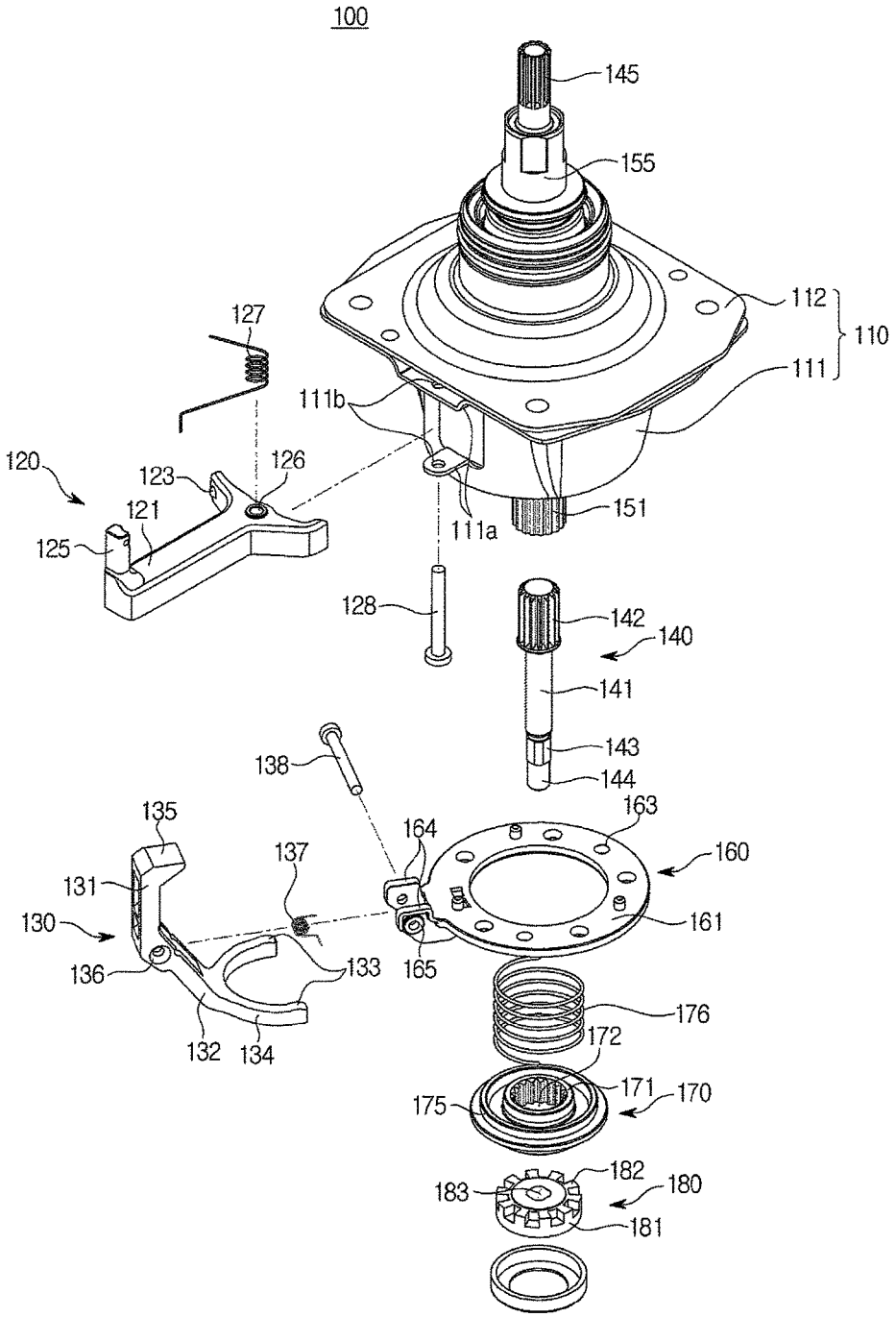
FIG. 4 illustrates the exploded clutch assembly included in the washing machine in accordance with one embodiment of the present disclosure.
Figure 5:
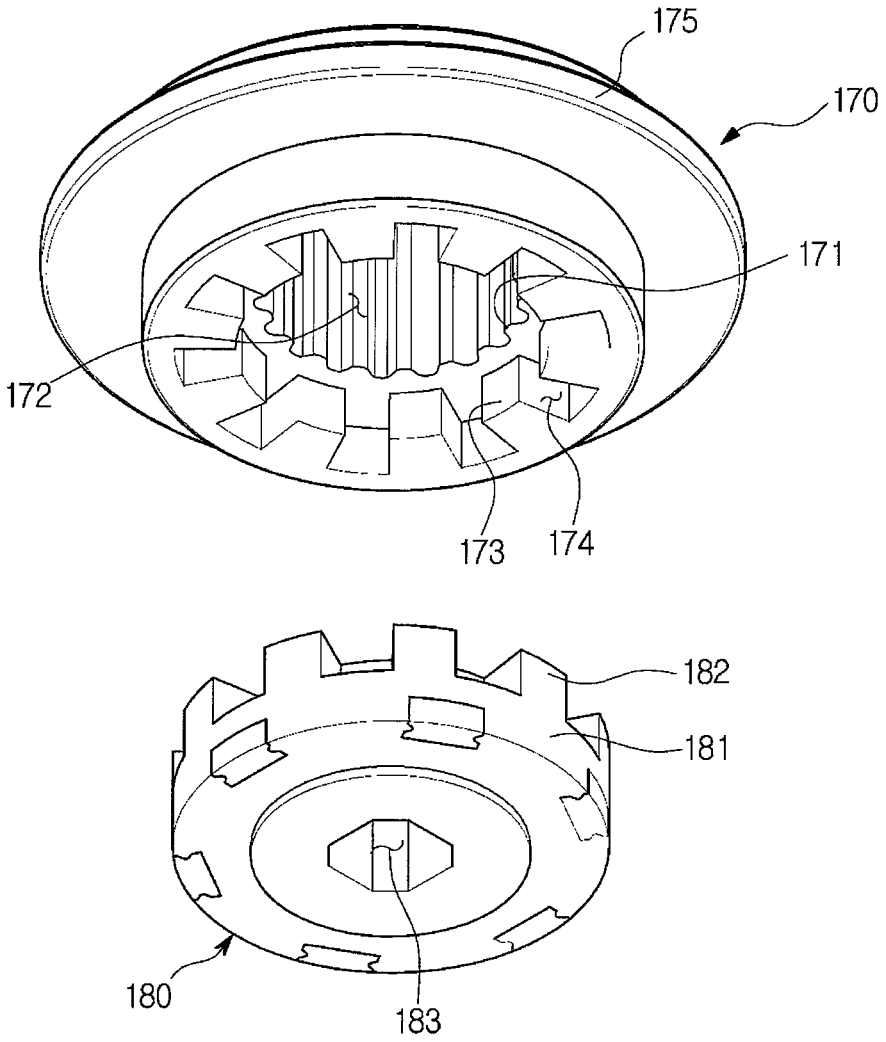
FIG. 5 illustrates a clutch boss and a clutch coupling of the clutch assembly included in the washing machine in accordance with one embodiment of the present disclosure.

FIG. 3 illustrates the clutch assembly 100 included in the washing machine 1 in accordance with one embodiment of the present disclosure. FIG. 4 illustrates the exploded clutch assembly 100 included in the washing machine 1 in accordance with one embodiment of the present disclosure. FIG. 5 illustrates a clutch boss 180 and a clutch coupling 170 of the clutch assembly 100 included in the washing machine 1 in accordance with one embodiment of the present disclosure.

Referring to FIGS. 3 to 5, a clutch housing 110 formed by coupling an upper housing 112 and a lower housing 111 forms an external shape of the clutch assembly 100. In the clutch housing 110, a washing shaft 145 and a spin-drying shaft 155 are installed to protrude above the clutch housing 110.

The spin-drying shaft 155 can be formed of a cylindrical shaft with a hollow center and the washing shaft 145 can be inserted into a hollow of the spin-drying shaft 155. The spin-drying shaft 155 and the washing shaft 145 are coupled to each other to be rotatable simultaneously or separately. The washing shaft 145 extends to further protrude upward than the spin-drying shaft 155 and is coupled with the pulsator 40. The spin-drying shaft 155 is coupled with the rotating tub 30. The washing shaft 145 allows the pulsator 40 to rotate. The spin-drying shaft 155 allows the rotating tub 30 to rotate.

A housing gear 151 can be formed at a bottom of the clutch housing 110 while protruding downward. The housing gear 151 can be connected to the spin-drying shaft 155 in the clutch housing 110. That is, when the housing gear 151 rotates, the spin-drying shaft 155 and the rotating tub 30 connected to the spin-drying shaft 155 are allowed to rotate.

The housing gear 151 can be formed to be with a hollow center. The driven shaft 140 can be inserted into a hollow of the housing gear 151. The driven shaft 140 is connected to the washing shaft 145 while penetrating the hollow of the housing gear 151. Accordingly, when the driven shaft 140 rotates, the washing shaft 145 and the pulsator 40 connected to the washing shaft 145 are allowed to rotate.

The driven shaft 140 includes a shaft body 141 which has a rod shape and forms a body. A shaft gear 142 can be formed above the shaft body 141. The shaft gear 142 can be coupled with a reduction gear (not shown) provided in the clutch housing 110. The reduction gear can allow rotary speeds of the driven shaft 140 and the washing shaft 145 to be identical or to differ through controlling a gear ratio of the driven shaft 140 to the shaft gear 142.

A boss coupling portion 143 for coupling with the clutch boss 180 can be formed below the shaft body 141. The boss coupling portion 143 can be formed to have a polygonal cross section not a circular one to be strongly coupled with the clutch boss 180. Depending on embodiments, a shape of the cross section of the boss coupling portion 143 can include a circle and other polygons.

A shaft bottom end 144 of the shaft body 141 is coupled with the driven pulley 93. Accordingly, when the driving motor 80 rotates, the driven shaft 140 is allowed to rotate.

The clutch boss 180 is configured to include a boss body 181 and a shaft coupling hole 183 formed by opening a central portion of the boss body 181. The shaft coupling hole 183 is formed in a shape corresponding to that of the boss coupling portion 143 of the shaft body 141 to allow the driven shaft 140 and the clutch boss 180 to be strongly coupled. Since the clutch boss 180 has to transfer torque of the driven shaft 140 which rotates due to the driven pulley 93 to the rotating tub 30 through the clutch coupling 170, the housing gear 151, and the spin-drying shaft 155, it is necessary to be strongly coupled with the driven shaft 140.

A plurality of boss protrusions 182 to be coupled with a plurality of coupling protrusions 173 of the clutch coupling 170 are formed above the boss body 181.

The clutch coupling 170 is disposed between a bottom side of the clutch housing 110 and the clutch boss 180.

The clutch coupling 170 is configured to be coupled with the clutch boss 180, to receive torque through the driven shaft 140 and the clutch boss 180, and to transfer the torque to the housing gear 151, the spin-drying shaft 155, and the rotating tub 30.

The clutch coupling 170 includes a shaft through hole 172 formed by perforating a central portion thereof to allow a body of the driven shaft 140 to penetrate therethrough. A coupling tooth form 171 is formed on an inner side of the shaft through hole 172 to be engaged with and fixed to the housing gear 151.

A mounting portion 175 is formed while protruding along a circumference of the central portion of the clutch coupling 170 from a radial direction. A coupling elastic member 176 is mounted on a top side of the mounting portion 175, and a coupling lever 130 is in contact with a bottom side of the mounting portion 175.

The plurality of coupling protrusions 173 are formed below the clutch coupling 170 while protruding inward in the radial direction. A plurality of coupling grooves 174 are each formed among the plurality of coupling protrusions 173. The coupling protrusions 173 are formed to allow the coupling grooves 174 to be formed in a shape corresponding to that of the boss protrusions 182 of the clutch boss 180.

The clutch coupling 170 is disposed below the clutch housing 110 to allow the coupling tooth form 171 to be coupled with the housing gear 151. The driven shaft 140 penetrates the shaft through hole 172 and is coupled with the clutch boss 180 below the clutch coupling 170.

As the coupling tooth form 171 slides along sawteeth of the housing gear 151, the clutch coupling 170 is disposed to be vertically movable.

When the clutch coupling 170 descends, the boss protrusions 182 of the clutch boss 180 are inserted into the coupling grooves 174, thereby coupling the clutch coupling 170 with the clutch boss 180. Accordingly, when the driven shaft 140 rotates, the clutch boss 180 fixed to the driven shaft 140 rotates and the clutch coupling 170 also rotates according thereto. When the clutch coupling 170 rotates, the housing gear 151 coupled through the coupling tooth form 171 rotates and the spin-drying shaft 155 and the rotating tub 30 rotate according thereto. In other words, the clutch assembly 100 operates in the spin-drying mode.

When the clutch coupling 170 ascends, the clutch boss 180 and the clutch coupling 170 are separated from each other and disconnected. Accordingly, the clutch coupling 170 does not rotate and also the housing gear 151, the spin-drying shaft 155, and the rotating tub 30 do not rotate. In other words, the clutch assembly 100 operates in the washing mode.

The coupling lever 130 includes a lever top portion 131 and a lever bottom portion 132. The lever top portion 131 and the lever bottom portion 132 are formed to have a certain angle therebetween based on first rotation center holes 136.

A coupling guide 133 is formed while protruding forward from a bottom end of the lever bottom portion 132. The coupling guide 133 can be formed while being divided into two from the bottom end of the lever bottom portion 132. The two coupling guides 133 can be formed in an annular shape with one open side.

A first contact protrusion 134 is formed at an end of each of the coupling guides 133 while protruding upward. The first contact protrusion 134 is in contact with the bottom side of the mounting portion 175 of the clutch coupling 170.

A first stopper 135 can be formed while protruding forward from a top end of the lever top portion 131. The first stopper 135 is in contact with a housing side to limit pivoting of the coupling lever 130.

The coupling lever 130 is pivotally installed on a lever holder 160. The lever holder 160 is mounted on a bottom side of the lower housing 111. An annular holder plate 161 forms an external shape of the lever holder 160.

Two first mounting portions 164 spaced apart at a certain interval from the holder plate 161 are provided. First mounting holes 165 are formed in the first mounting portions 164. The coupling lever 130 is coupled with the lever holder 160 to dispose the first rotation center holes 136 between the two first mounting portions 164. A first elastic member 137 is disposed between the two first rotation center holes 136. A first coupling pin 138 penetrates the first mounting holes 165, the first rotation center holes 136, and the first elastic member 137 to couple the coupling lever 130 with the lever holder 160.

The coupling lever 130 pivots on the first rotation center holes 136 to allow the coupling guides 133 to ascend and descend. Also, the coupling guides 133 of the coupling lever 130 are in contact with the clutch coupling 170 to allow the clutch coupling 170 to vertically move.

The first elastic member 137 pressurizes the coupling lever 130 due to elasticity thereof to allow the coupling guides 133 of the coupling lever 130 to descend.

A plurality of coupling holes 163 can be formed in the holder plate 161 while penetrating the holder plate 161. As a fastening member (not shown) penetrates the coupling holes 163 and is inserted into the lower housing 111, the lever holder 160 can be coupled with the clutch housing 110.

A clutch lever 120 is mounted on the housing side to be pivotable along a horizontal direction based on a second rotation center hole 126 formed in an end of a lever body 121. Two second mounting portions 111*a* are formed on the housing side while being spaced apart at a certain interval to install the clutch lever 120. Second mounting holes 111*b* are formed in the second mounting portions 111*a*. The clutch lever 120 is mounted on the second mounting portions 111*a* to dispose the second rotation center hole 126 between the two second mounting portions 111*a*. A second elastic member 127 is disposed between the second rotation center holes 126 and one of the second mounting holes 111*b*. A second coupling pin 128 penetrates the second mounting holes 111*b*, the second rotation center hole 126, and the second elastic member 127 to couple the clutch lever 120 with the clutch housing 110.

A lever guide 123 and a second stopper 122 can be formed at the end of the lever body 121. The lever guide 123 and the second stopper 122 are diverged from the end of the lever body 121 to be in mutually opposite directions based on the second rotation center hole 126.

The lever guide 123 and the second stopper 122 are formed to be adjacent to the housing side while the second stopper 122 is bent toward the housing side.

The lever guide 123 is in contact with or separated from the lever top portion 131 of the coupling lever 130. Particularly, a side of the lever guide 123 opposite a side adjacent to the housing side is in contact with or separated from the lever top portion 131. A second contact protrusion 124 protrudes from a part of the lever guide 123, adjacent to the lever top portion 131.

In the lever body 121, a connection portion 125 to which the drainage motor 73 for driving the clutch lever 120 is connected is formed at an end opposite the part at which the lever guide 123 and the second stopper 122 are formed.

The clutch lever 120 is configured to be pivotable in the horizontal direction based on the second rotation center hole 126. The second elastic member 127 pressurizes the clutch lever 120 in a direction in which the second stopper 122 is located. Accordingly, when an external force is not applied, a state in which the second stopper 122 is in contact with the housing side is maintained.

When the clutch lever 120 pivots in the direction in which the second stopper 122 is located, the lever guide 123 pushes the lever top portion 131 of the coupling lever 130 aside. When the lever top portion 131 is pushed aside, the coupling guides 133 ascend and the clutch coupling 170 ascends. Due to ascending of the clutch coupling 170, the clutch coupling 170 and the clutch boss 180 are separated. In other words, the clutch assembly 100 operates in the washing mode.

Here, due to elastic forces of the first elastic member 137 and the coupling elastic member 176, the clutch coupling 170 and the coupling guides 133 are pressurized downward. The clutch coupling 170 and the coupling guides 133 can ascend when receiving a force greater than the elastic forces. Accordingly, an elastic force of the second elastic member 127 can be greater than a sum of the elastic force of the first elastic member 137 and the elastic force of the coupling elastic member 176.

On the other hand, when the clutch lever 120 overcomes the elastic force of the second elastic member 127 and pivots in a direction in which the lever guide 123 extends due to the drainage motor 73, the lever guide 123 does not push the lever top portion 131 any more and is separated from the lever top portion 131.

When an external force applied to the coupling lever 130 is removed, due to the elastic forces of the second elastic member 127 and the coupling elastic member 176, the coupling lever 130 pivots to allow the coupling guides 133 to descend and the clutch coupling 170 also descends. When the clutch coupling 170 descends, the clutch coupling 170 is coupled with the clutch boss 180 in such a way that the clutch boss 180 and the clutch coupling 170 rotate at the same time. In other words, the clutch assembly 100 operates in the spin-drying mode.

As described above, the clutch assembly 100 can operate in the washing mode of transferring the torque to the pulsator 40 and in the spin-drying mode of transferring the torque to the pulsator 40 and the rotating tub 30 depending on whether the drainage motor 73 operates.

Figure 6:
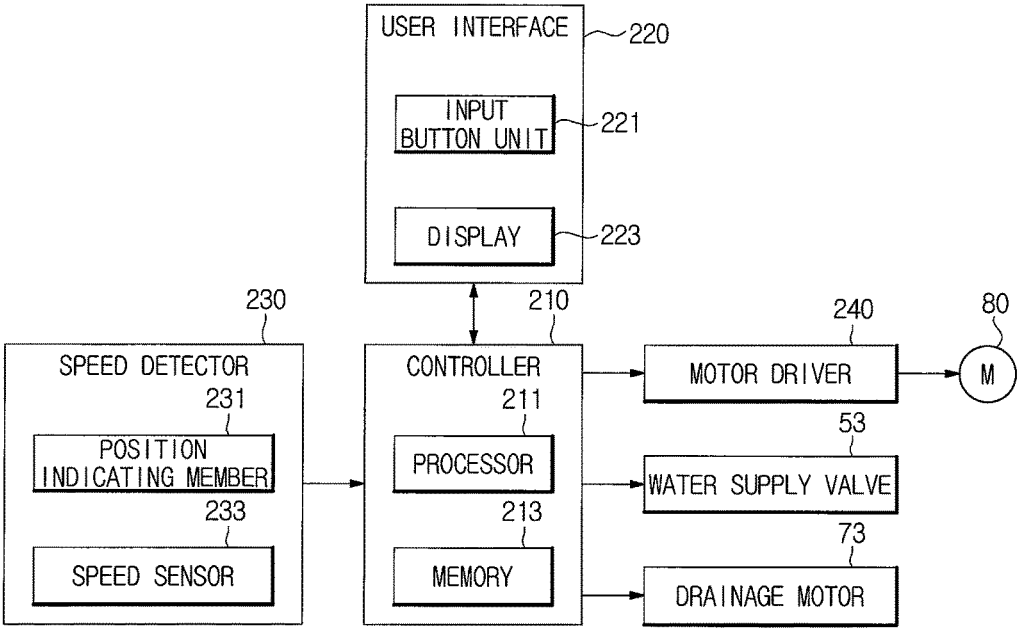
FIG. 6 illustrates a configuration for controlling an operation of the washing machine in accordance with one embodiment of the present disclosure.
Figure 7A:
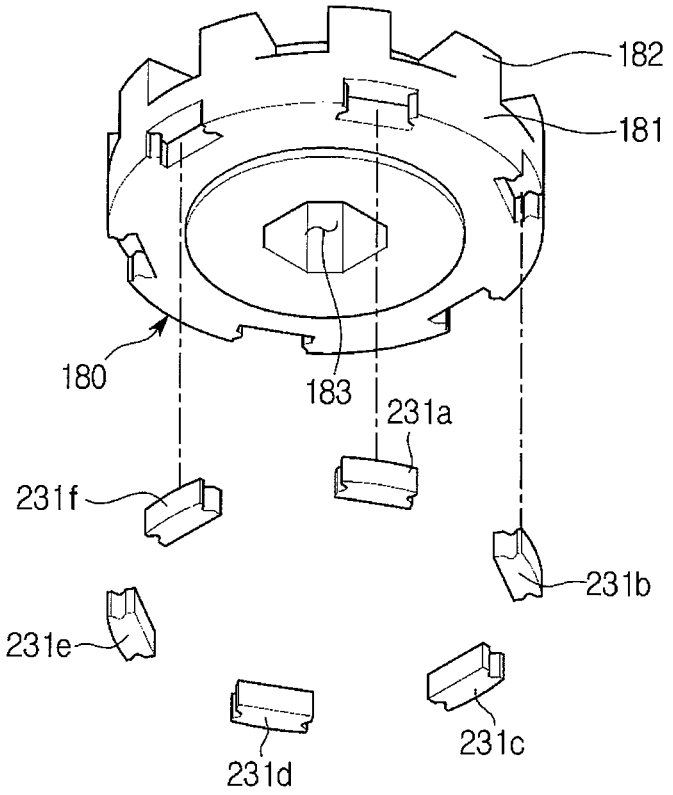
FIGS. 7A and 7B illustrate a speed detector included in the washing machine in accordance with one embodiment of the present disclosure.
Figure 7B:
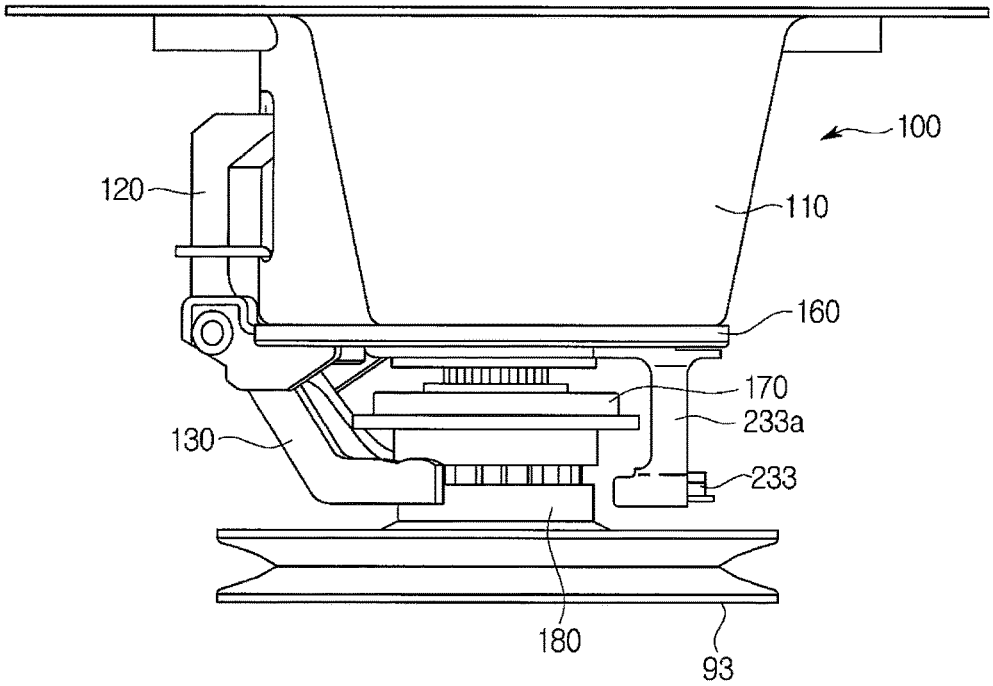
Figure 8:
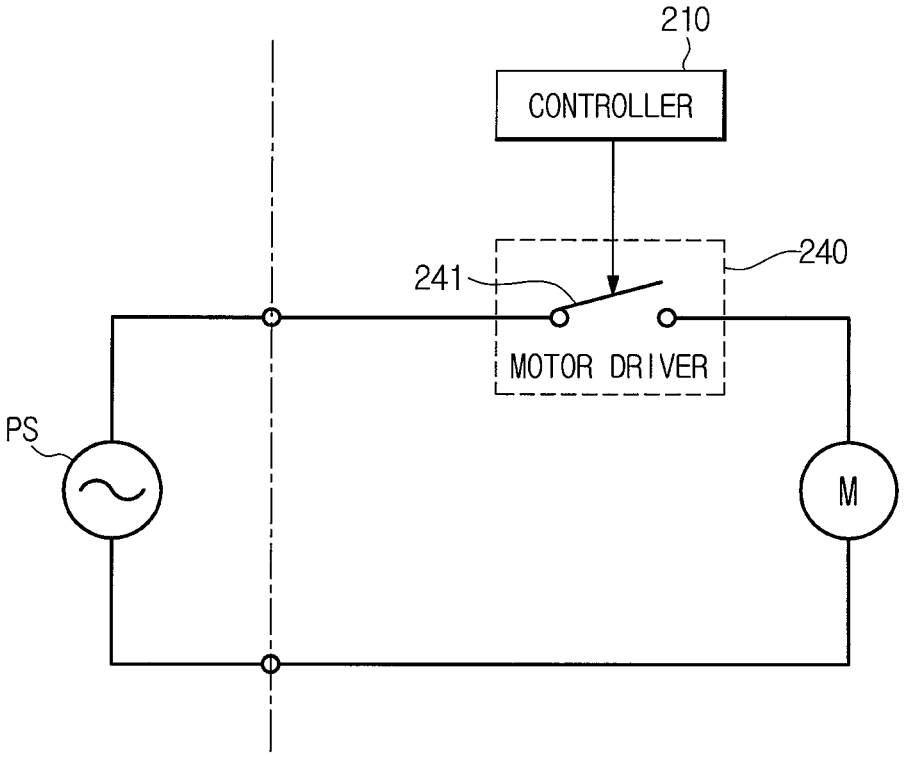
FIG. 8 illustrates a motor driver included in the washing machine in accordance with one embodiment of the present disclosure.

FIG. 6 illustrates a configuration for controlling an operation of the washing machine 1 in accordance with one embodiment of the present disclosure. FIGS. 7A and 7B illustrate a speed detector 230 included in the washing machine 1 in accordance with one embodiment of the present disclosure. FIG. 8 illustrates a motor driver 240 included in the washing machine 1 in accordance with one embodiment of the present disclosure.

Referring to FIGS. 6 to 8, the washing machine 1 includes a user interface 220 which interacts with a user, the speed detector 230 which detects the rotary speed of the rotating tub 30 or the pulsator 40, the motor driver 240 which drives the driving motor 80, and a controller 210 which controls operations of various components included in the washing machine 1, in addition to the cabinet 10, the tub 20, the rotating tub 30, the pulsator 40, the water supply unit 50, the detergent supply unit 60, the drainage unit 70, the driving motor 80, the pulley unit 90, and the clutch assembly 100 described above.

Since the water supply valve 53 and the drainage motor 73 shown in FIG. 6 have been described above, a description thereof will be omitted.

The user interface 220 can include an input button unit 221 and a display 223.

The input button unit 221 receives various setting values related to washing and control commands related to the washing machine 1 from the user and outputs electric signals corresponding to the setting value and the control command input by the user to the controller 210.

For example, the input button unit 221 can include a plurality of operation buttons which receive the control command with respect to the washing machine 1 and a dial which receives settings for a washing operation. The washing machine 1 can receive a washing mode from the user through the dial and can receive additional washing settings such as a washing temperature, a number of times of washing, a number of times of rinsing, and a level of spin-drying through the operation buttons. The operation buttons described above can employ push switches, membrane switches, or a touch pad.

The display 223 can display operation information of the washing machine 1 to the user as visual images according to a control signal of the controller 210.

For example, before the washing operation, the washing machine 1 can display the washing mode selected by the user, the additional washing settings input by the user such as the washing temperature, the number of times of rinsing, the level of spin-drying, etc., and an estimated washing time until washing is completed through the display 223. Also, during the washing operation, the washing machine 1 can display information on an operation in progress, for example, whether the operation is the washing operation, the rinsing operation, or the spin-drying operation, a residual washing time left until the washing is completed, etc. through the display 223.

The display 223 described above can employ one of a light emitting diode (LED) panel, a liquid crystal display (LCD) panel, and an organic LED (OLED) panel.

Also, the user interface 220 can include a touch screen in which an input means and a display means are integrated.

A touch screen panel displays setting values or control commands selectable by the user through the display 223. When the user selects and touches any one of the setting values and the control commands displayed on the touch screen panel, the touch screen panel can detect coordinates of the touch of the user and compares the detected coordinates of the touch with coordinates on which the setting value or the control command is displayed, thereby recognizing the setting value or the control command input by the user.

The speed detector 230 includes a position indicating member 231 and a speed sensor 233.

The position indicating member 231 is installed in the driving motor 80 or the clutch assembly 100 and indicates rotation of the driving motor 80 or the clutch assembly 100. The speed sensor 233 senses the position indicating member 231 and outputs an electric signal corresponding to whether the position indicating member 231 is sensed, to the controller 210. Also, the controller 210 can determine the rotary speed of the rotating tub 30 based on the electric signal output from the speed sensor 233.

For example, the speed sensor 233 can output "a high signal" when the position indicating member 231 is sensed and can output "a low signal" when the position indicating member 231 is not sensed. When the driving motor 80 or the clutch assembly 100 rotates, the speed sensor 233 can regularly detect the position indicating member 231 and can output the electric signal in a pulse form.

The controller 210 can analyze an electric pulse output from the speed sensor 233 to calculate a frequency or period of the electric pulse and can determine the rotary speed of the rotating tub 30 based on the calculated frequency or period of the electric pulse.

The position indicating member 231 can be located in a rotating component such as the driving shaft 85 and the driven shaft 140. Also, the speed sensor 233 can be located in a fixed component such as the motor housing 81 and the clutch housing 110.

For example, the position indicating member 231 can be provided in the clutch boss 180 which rotates at the same rotary speed as that of the driven shaft 140. In detail, as shown in FIG. 7A, one or more position indicating members 231*a*, 231*b*, 231*c*, 231*d*, 231*e*, and 231*f* can be disposed at equidistant intervals along an outer circumferential surface of the clutch boss 180. Here, the number of position indicating members 231 is six in FIG. 7 but is not limited thereto.

When the position indicating member 231 is provided in the clutch boss 180 of the clutch assembly 100, the speed sensor 233 can be provided in a position adjacent to the clutch boss 180. In detail, the speed sensor 233, as shown in FIG. 7B, can be supported by a sensor supporter 233*a* to be installed adjacent to the outer circumferential surface of the clutch boss 180. Here, the sensor supporter 233*a* can extend downward from the bottom side of the clutch housing 110 toward the driven pulley 93.

As described above, the speed sensor 233 is installed adjacent to the clutch boss 180 in which a plurality of such position indicating members 231*a*, 231*b*, 231*c*, 231*d*, 231*e*, and 231*f* are installed, thereby allowing the speed sensor 233 to regularly sense the position indicating members 231*a*, 231*b*, 231*c*, 231*d*, 231*e*, and 231*f* while the clutch boss 180 rotates.

However, positions of the position indicating members 231*a*, 231*b*, 231*c*, 231*d*, 231*e*, and 231*f* are not limited to the clutch boss 180 but can be various.

For example, the position indicating member 231 can be provided in the driven pulley 93 coupled with the driven shaft 140 and the speed sensor 233 can be provided below the clutch housing 110. The position indicating member 231 can rotate together with the driven pulley 93. The speed sensor 233 can regularly detect the position indicating member 231 while the position indicating member 231 rotates.

As another example, the position indicating member 231 can be provided on an external surface of the reduction gear provided in the clutch housing 110 and the speed sensor 233 can be provided on one side of the clutch housing 110. The position indicating member 231 can rotate together with the reduction gear. The speed sensor 233 can regularly detect the position indicating member 231 while the position indicating member 231 rotates.

As still another example, the position indicating member 231 can be provided in the driving pulley 91 coupled with the driving shaft 115 and the speed sensor 233 can be provided below the motor housing 81. The position indicating member 231 can rotate together with the driving pulley 91. The speed sensor 233 can regularly detect the position indicating member 231 while the position indicating member 231 rotates.

The position indicating member 231 and the speed sensor 233 can employ various components which detect rotational displacement or a rotary speed of a rotor, respectively.

For example, the position indicating member 231 can include a permanent magnet which generates a magnetic field, a reflecting plate which reflects light, and a protrusion which protrudes toward the speed sensor 233. Also, the speed sensor 233 can include a hall sensor or a magnetoresistive (MR) sensor which detects a magnetic field depending on the position indicating member 231, an infrared sensor which transmits light and detects the light reflected by the reflecting plate, and a micro switch pressurized by the protrusion.

In detail, when the position indicating member 231 includes the permanent magnet, the speed sensor 233 can include the hall sensor or the MR sensor. When the position indicating member 231 includes the reflecting plate, the speed sensor 233 can include the infrared sensor. When the position indicating member 231 includes the protrusion, the speed sensor 233 can include the micro switch.

Hereinafter, for understanding, it will be described while it is assumed that the position indicating member 231 includes the permanent magnet and the speed sensor 233 includes the hall sensor or the MR sensor.

The motor driver 240 includes a driving switch unit 241 which supplies power to the driving motor 80 or cuts off the power supplied to the driving motor 80 depending on a driving signal of the controller 210 which will be described below.

The driving switch unit 241, as shown in FIG. 8, can be connected to an external power supply PS and the driving motor 80 in series. Also, when the driving switch unit 241 is turned on, the power is supplied to the driving motor 80 to drive the driving motor 80. When the driving switch unit 241 is turned off, the power supplied to the driving motor 80 is cut off to stop the driving motor 80.

As described above, the washing machine 1 supplies or cuts off the power to the driving motor 80 to control the rotary speed of the driving motor 80 but does not control a level or frequency of a driving voltage supplied to the driving motor 80.

The driving switch unit 241 can include a high voltage switch which conducts or cuts off the power supplied to the driving motor 80 from the external power supply PS depending on the driving signal output from the controller 210. For example, the driving switch unit 241 can include a relay, a photo-coupler, a thyristor, a triac, a power bipolar junction transistor (BJT), a power metal-oxide-semiconductor field effect transistor (MOSFET), a static induction transistor (SIT), an insulated gate bipolar transistor (IGBT), etc.

The driving switch unit 241, in addition to the high voltage switch described above, can further include a zero-crossing detector which detects a point in time when a voltage and current of AC power input from the external power supply PS become "0" and a porter coupler which isolates the controller 210 formed of a low voltage device for the external power supply PS and the driving motor 80 to which a high voltage is supplied or cut off.

The controller 210 can include a memory 213 which stores a program and data for controlling the washing machine 1 and a processor 211 which processes the data according to the program stored in the memory 213.

The memory 213 can store a control program and control data for controlling the washing machine 1 or can store setting values and control commands input through the user interface 220, a rotary speed input from the speed detector 230, and control signals output by the processor 211.

The memory 213 can include a volatile memory (not shown) such as a static random access memory (S-RAM) and a dynamic random access memory (D-RAM) and a nonvolatile memory (not shown) such as a flash memory, a read only memory (ROM), and an erasable programmable read only memory (EPROM), and an electrically EPROM (EEPROM).

The nonvolatile memory can operate as an auxiliary memory for the volatile memory and can store the control program and control data for controlling the operation of the washing machine 1. The nonvolatile memory can keep stored data even though power of the washing machine 1 is cut off.

The volatile memory can load and temporarily store the control program and control data for controlling the washing machine 1 or can temporarily store the setting values and control commands input through the user interface 220, the rotary speed input from the speed detector 230, and the control signals output by the processor 211. The volatile memory, unlike the nonvolatile memory, can lose stored data when the power of the washing machine 1 is cut off.

The processor 211 can process the setting values, control commands, and rotary speed according to the control programs and control data stored in the memory 213 and can output a driving signal for controlling the driving motor 80 and the control signals for controlling the water supply valve 53 and the drainage motor 73.

For example, the processor 211 can determine a washing time, a number of times of rinsing, and a spin-drying time according to the setting values and control commands input by the user. During the washing operation and rinsing operation, the processor 211 can output a control signal of opening the water supply valve 53, a driving signal of rotating the driving motor 80 clockwise or counterclockwise, and a control signal for operating the drainage motor 73. Also, during the spin-drying operation, the processor 211 can output the control signal of operating the drainage motor 73 and a driving signal of operating or stopping the driving motor 80 depending on the rotary speed of the clutch assembly 100 detected by the speed detector 230.

In the above, the processor 211 and the memory 213 have been separately described but are not limited thereto and can be formed as a single chip.

As described above, the controller 210 can control the operations of all kinds of the components included in the washing machine 1. Also, it will be understood that the operation of the washing machine 1 which will be described below can be performed according to a control operation of the controller 210.

As described above, the components of the washing machine 1 have been described.

Hereinafter, the operation of the washing machine 1, and more particularly, the spin-drying operation will be described.

The user can select a washing mode through the user interface 220 and can input detailed setting values such as a washing temperature, a number of times of rinsing, and a level of spin-drying depending on each washing mode. After that, when the user inputs an operation start command through the user interface 220, the washing machine 1 can perform a series of operations which will be described below.

First, the washing machine 1 can detect an amount of laundry to determine an amount of water to be supplied to the tub 20 during the washing operation or the rinsing operation.

For example, the washing machine 1 can operate the driving motor 80 for a predetermined time and can detect an amount of laundry contained in the rotating tub 30 based on changes in a driving current supplied to the driving motor 80 and in the rotary speed of the clutch assembly 100. In other words, the washing machine 1 can calculate the amount of the laundry using a fact in which the rotary speed of the clutch assembly 100 becomes smaller as the amount of the laundry contained in the rotating tub 30 becomes larger. After that, the washing machine 1 can determine the amount of water to be supplied to the tub 20 during the washing operation or rinsing operation depending on the detected amount of the laundry.

Additionally, the washing machine 1 may not calculate the amount of the laundry and can directly determine the amount of the water to be supplied to the tub 20 based on the changes in the driving current supplied to the driving motor 80 and in the rotary speed of the clutch assembly 100.

As another example, the washing machine 1 can include a weight sensor which senses a weight in the damper 21 supporting the tub 20 and can detect the amount of the laundry contained in the rotating tub 30 based on an output of the weight sensor.

After that, the washing machine 1 performs the washing operation.

The washing operation includes water supply of supplying water to the tub 20, washing of washing laundry by rotating the pulsator 40, drainage of discharging the water from the tub 30, and intermediate spin-drying of separating the water from the laundry by rotating the rotating tub 30.

During the water supply, the washing machine 1 opens the water supply valve 53 and supplies the water and a detergent to the tub 20.

During the washing, the washing machine 1 generates a water current which rotates in the rotating tub 30 by alternately rotating the pulsator 40 clockwise and counterclockwise. Due to the water current which rotates described above, the laundry in the rotating tub 30 is washed. Particularly, the washing machine 1 can transfer the torque of the driving motor 80 to the pulsator 40 by switching the clutch assembly 100 into the washing mode.

During the drainage, the washing machine 1 opens the drain valve 72 by operating the drainage motor 73. Also, the clutch assembly 100 is switched into the spin-drying mode by operating of the drainage motor 73.

During the intermediate spin-drying, the washing machine 1 operates the driving motor 80 to rotate the rotating tub 30. Here, the operating of the drainage motor 73 is maintained to allow the clutch assembly 100 to maintain the spin-drying mode. As described above, since the clutch assembly 100 operates in the spin-drying mode, the torque of the driving motor 80 can be transferred to both the rotating tub 30 and the pulsator 40.

After that, the washing machine 1 performs the rinsing operation.

The rinsing operation includes water supply of supplying water to the tub 20, rinsing of rinsing laundry by rotating the pulsator 40, drainage of discharging the water from the tub 30, and intermediate spin-drying of separating the water from the laundry by rotating the rotating tub 30.

During the rinsing, the washing machine 1 generates a water current which rotates in the rotating tub 30 by alternately rotating the pulsator 40 clockwise and counterclockwise. Due to the water current which rotates described above, the laundry in the rotating tub 30 is rinsed. The water supply, drainage, and intermediate spin-drying are identical to those of the washing operation described above.

After that, the washing machine 1 performs the spin-drying operation. During the spin-drying operation, the washing machine 1 maintains the clutch assembly 100 in the spin-drying mode to allow the torque of the driving motor 80 to be transferred to both the rotating tub 30 and the pulsator 40.

The spin-drying operation includes intermittent spin-drying of gradually increasing a rotary speed of the rotating tub 30 and main spin-drying of rotating the rotating tub 30 at a high speed. Not only the spin-drying operation but also the intermediate spin-drying of the washing operation and the intermediate spin-drying of the rinsing operation can include the intermittent spin-drying and the main spin-drying.

The intermittent spin-drying and the main spin-drying will be described below in detail.

In the above, the operation of the washing machine 1 includes the washing operation, the rinsing operation, and the spin-drying operation but is not limited thereto. For example, the washing machine 1 can perform some of the washing operation, the rinsing operation, and the spin-drying operation depending on a selection of the user. In detail, the user can operate the washing machine to perform only the washing machine 1 for rough washing or can operate the washing machine 1 to perform only the spin-drying operation after hand-washing.

As described above, the spin-drying operation includes the intermittent spin-drying and the main spin-drying.

During the intermittent spin-drying, the washing machine 1 gradually increases the rotary speed of the rotating tub 30 to discharge the water separated from the laundry. During the main spin-drying, the washing machine 1 maintains the rotary speed of the rotating tub 30 at a maximum rotary speed. When the rotary speed of the rotating tub 30 is rapidly increased, the water separated from the laundry is not yet discharged and collected at the bottom of the tub 20. As described above, the water collected at the bottom of the tub 20 interrupts rotation of the rotating tub 30 to increase a load on the driving motor 80.

When the load on the driving motor 80 increases to a certain level or more, an operation of the driving motor 80 stops. As described above, to prevent the load on the driving motor 80 from being rapidly increased, the washing machine 1 performs the intermittent spin-drying of gradually increasing the rotary speed of the rotating tub 30.

The washing machine 1 repetitively performs operating and stopping the operating of the driving motor 80 using an AC motor to gradually increase the rotary speed of the rotating tub 30.

The washing machine 1 can determine whether to operate the driving motor 80 or to stop an operation thereof based on various conditions. For example, the washing machine 1 can determine a point in time of operating the driving motor 80 and a point in time of stopping the operating of the driving motor 80 based on the amount of the laundry.

Also, to determine the point in time of operating the driving motor 80 and the point in time of stopping the operating of the driving motor 80, a resonance phenomenon which occurs while the rotating tub 30 rotates can be considered.

The rotary speed of the rotating tub 30 in the spin-drying operation, particularly, in the intermittent spin-drying passes at least one resonance speed.

A resonance is a phenomenon in which vibration of the tub 20 extremely increases due to the rotation of the rotating tub 30. The vibration of the tub 20 is amplified at a certain rotary speed. When the resonance phenomenon occurs, vibration of the washing machine 1 and noise caused by the vibration extremely increase and the washing machine 1 can be damaged in severe cases.

The resonance caused by the rotation of the rotating tub 30 can be generally divided into two types. Although a difference is present depending on a size of the rotating tub 30, there are present a first resonance which occurs when the rotary speed of the rotating tub 30 is about 100 rpm and a second resonance which occurs when the rotary speed of the rotating tub 30 is about 300 rpm. During the first resonance, the whole tub 20 which accommodates the rotating tub 30 extremely vibrates left and right. Also, during the second resonance, a top and a bottom of the tub 20 which accommodates the rotating tub 30 vibrate in mutually opposite directions.

The first resonance and second resonance described above do not occur only at a certain rotary speed can occur at a sequential rotary speed range. Hereinafter, a rotary speed area in which the first resonance occurs will be referred to a first resonance area R1 and a rotary speed area in which the second resonance occurs will be referred to as a second resonance area R2.

The vibration caused by the resonance phenomenon described above can be minimized by reducing a number in which the rotary speed of the rotating tub 30 passes a resonance area or increasing a weight of the tub 20 which accommodates the rotating tub 30.

As described above, to reduce a time in which the rotary speed of the rotating tub 30 passes the resonance area or the number in which the rotary speed of the rotating tub 30 passes the resonance area, the operating of the driving motor 80 and the stopping the operating of the driving motor 80 can be repetitively performed.

For example, the washing machine 1 can operate the driving motor 80 for a time previously determined based on an operation time of the driving motor 80 and can stop the operating of the driving motor 80 for a predetermined time.

Figure 9A:
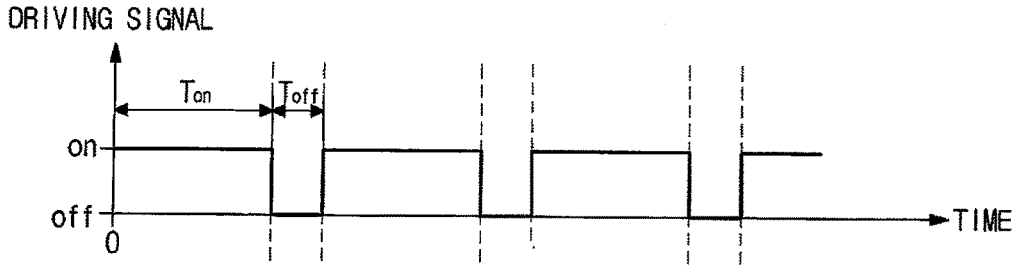
FIGS. 9A to 9C illustrate an example in which the washing machine in accordance with one embodiment of the present disclosure operates or stops a driving motor based on an operation time of the driving motor.
Figure 9B:
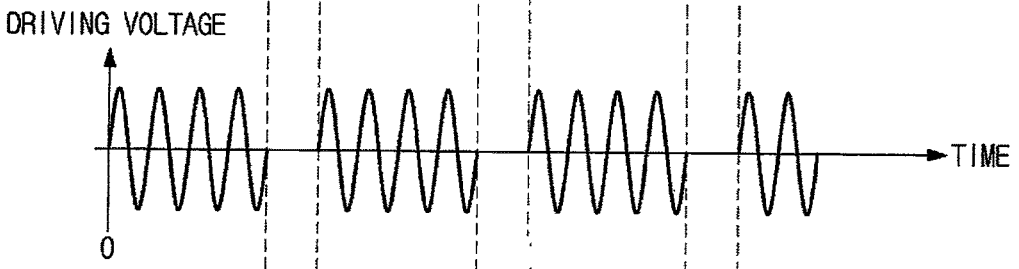
Figure 9C:
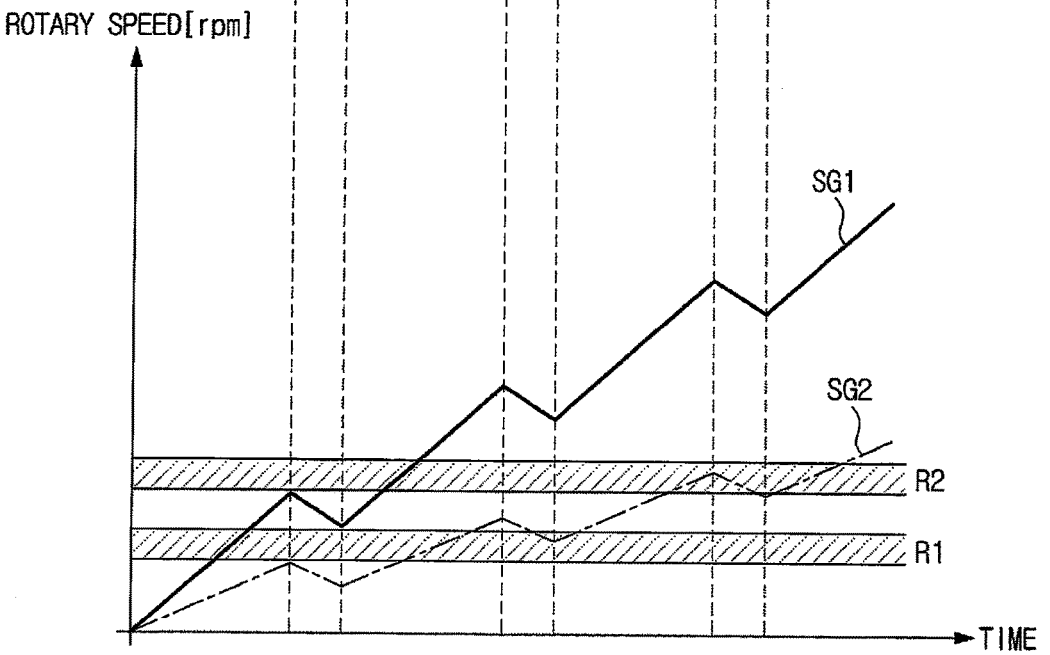

FIGS. 9A to 9C illustrate an example in which the washing machine 1 in accordance with one embodiment of the present disclosure operates or stops the operating of the driving motor 80 based on the operation time of the driving motor 80.

As shown in FIG. 9, the washing machine 1 can repetitively operate the driving motor 80 for a predetermined turn-on time Ton and stop the operating of the driving motor 80 for a turn-off time Toff.

In detail, the controller 210 of the washing machine 1 can transmit a driving signal shown in FIG. 9A to the motor driver 240. That is, the controller 210 repetitively turns on the driving switch unit 241 for the turn-on time $T_{on}$ and turns off the driving switch unit 241 for the turn-off time $T_{off}$.

Due to the driving signal shown in FIG. 9A, a driving voltage shown in FIG. 9B is supplied to the driving motor 80. That is, the power of the external power supply PS is supplied to the driving motor 80 during a time in which the driving switch unit 241 is turned on and is cut off during a time in which the driving switch unit 241 is turned off.

As a result thereof, as shown in FIG. 9C, the rotary speed of the rotating tub 30 varies. That is, the rotary speed of the rotating tub 30 increases during the time in which the driving switch unit 241 is turned on and decreases during the time in which the driving switch unit 241 is turned off.

The turn-on time Ton and the turn-off time $T_{off}$ of the driving switch unit 241 are appropriately set, thereby allowing the rotary speed of the rotating tub 30 to once pass the first resonance area R1 and the second resonance area R2 as shown in a first speed graph SG1 in FIG. 9C.

However, when an amount of laundry increases or a power supply which supplies electric energy to a driving motor is unstable, as shown in a second speed graph SG2 in FIG. 9C, a rotary speed of a rotating tub can pass the first resonance area R1 and the second resonance area R2 several times. As a result, vibration of the rotating tub can extremely increase during an intermittent spin-drying operation.

As another example, a target speed is preset and the washing machine 1 can operate the driving motor 80 to allow the rotary speed of the rotating tub 30 to get to the target speed. Here, the target speed can be preset by a designer for the washing machine 1 and stored in the memory 213 of the controller 210.

In detail, the washing machine 1 can compare the rotary speed detected by the speed detector 230 with the target speed and can control power supplied to the driving motor 80 according to a result of the comparison.

The washing machine 1 can use various methods for controlling the power supplied to the driving motor 80. The washing machine 1 can control a phase angle of the power supplied to the driving motor 80 or can intermittently supply the power to the driving motor 80.

Controlling of the phase angle of the power supplied to the driving motor 80 is generally referred to as "phase angle control". Intermittently supplying of the power to the driving motor 80 is generally referred to as "hysteresis control".

First, it will be described that the washing machine 1 controls the rotary speed of the rotating tub 30 through "phase angle control".

Figure 10A:
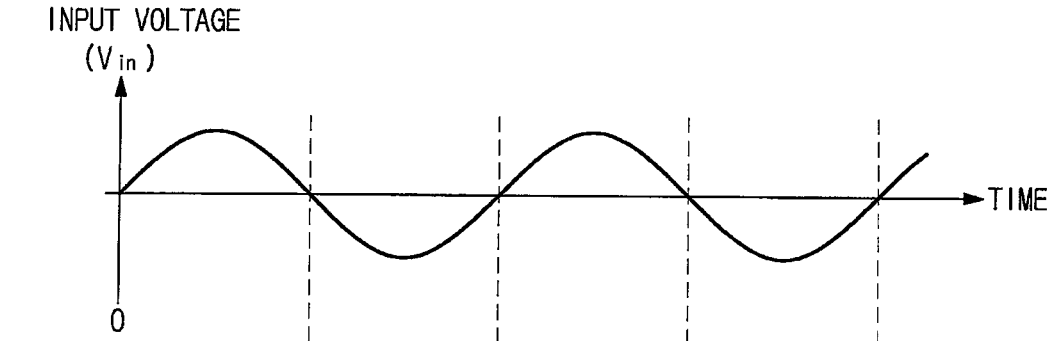
FIGS. 10A to 10C are views illustrating that the washing machine in accordance with one embodiment of the present disclosure controls a rotary speed of a rotating tub.
Figure 10B:
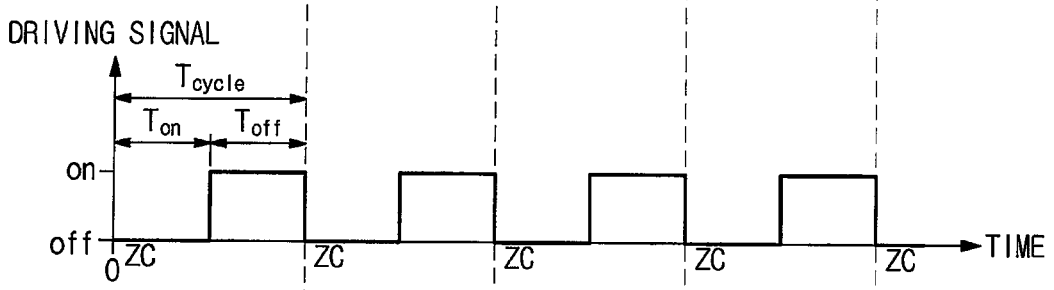
Figure 10C:
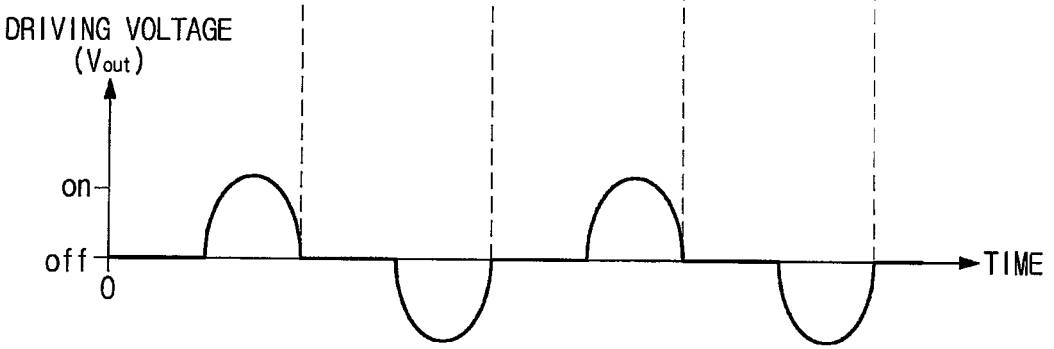

FIGS. 10A to 10C are views illustrating that the washing machine 1 in accordance with one embodiment of the present disclosure controls the rotary speed of the rotating tub 30.

The external power supply PS supplies an input voltage Vin to the washing machine 1 as shown in FIG. 10A. Here, the input voltage Vin input from the external power supply PS can be AC voltage which has a frequency of 50 Hz or 60 Hz and a voltage of 110 V or 220 V.

The controller 210 of the washing machine 1 can detect a point in time when the voltage of the input voltage Vin becomes "0" (hereinafter, referred to as "zero crossing ZC") using the zero crossing detector.

When the zero crossing ZC is detected, the controller 210 turns off the driving switch unit 241 of the motor driver 240 for the turn-off time $T_{off}$ from the zero crossing ZC as shown in FIG. 10B. Here, the turn-off time Toff can be set as a time shorter than one half cycle of the input voltage Vin and can vary according to the rotary speed of the rotating tub 30. When the rotary speed of the rotating tub 30 exceeds the target speed, the turn-off time $T_{off}$ increases. When the rotary speed of the rotating tub 30 is less than the target speed, the turn-off time $T_{off}$ is reduced.

When the driving switch unit 241 is turned off, as shown in FIG. 10C, a driving voltage Vout is not supplied to the driving motor 80.

When the turn-off time $T_{off}$ passes from the zero crossing ZC, the controller 210 turns on the driving switch unit 241.

When the driving switch unit 241 is turned on, as shown in FIG. 10C, the driving voltage Vout is supplied to the driving motor 80. Here, due to inductance of the driving motor 80, the driving voltage Vout has a sine wave form.

After that, when the zero crossing ZC is detected again, the controller 210 turns off the driving switch unit 241 of the motor driver 240 as shown in FIG. 10B. When the driving switch unit 241 is turned off, as shown in FIG. 10C, the supplying of the driving voltage Vout to the driving motor 80 is stopped again.

According to "the phase angle control" described above, only a part of input power supplied from the external power supply PS is transferred to the driving motor 80 and the rotary speed of the driving motor 80 varies according to driving power supplied to the driving motor 80.

Here, the controller 210 can control the rotary speed of the driving motor 80 by adjusting the turn-off time Toff. In detail, when the controller 210 increases the turn-off time Toff, the driving power supplied to the driving motor 80 is reduced and the rotary speed of the driving motor 80 is reduced. Also, when the controller 210 reduces the turn-off time $T_{off}$, the driving power supplied to the driving motor 80 increases and the rotary speed of the driving motor 80 increases.

Also, since the frequency of the input voltage Vin is preset, the controller 210 can control the rotary speed of the driving motor 80 by adjusting a duty ratio which indicates a ratio of the turn-on time Ton of turning on the driving switch unit 241 to one half cycle Tcycle of the input voltage Vin.

The adjusting of the turn-off time $T_{off}$ by the controller 210 has the same meaning as the adjusting of a duty ratio of the driving signal by the controller 210. When the controller 210 increases the turn-off time $T_{off}$, the duty ratio of the driving signal is reduced. When the controller 210 reduces the turn-off time $T_{off}$, the duty ratio of the driving signal increases.

Also, the increasing of the duty ratio of the driving signal by the controller 210 means the reducing of the turn-off time $T_{off}$ by the controller 210. The reducing of the duty ratio of the driving signal by the controller 210 means the increasing of the turn-off time $T_{off}$ by the controller 210.

Hereinafter, a method in which the washing machine 1 controls the rotary speed of the rotating tub 30 using "phase angle control" will be described in detail.

Figure 11:
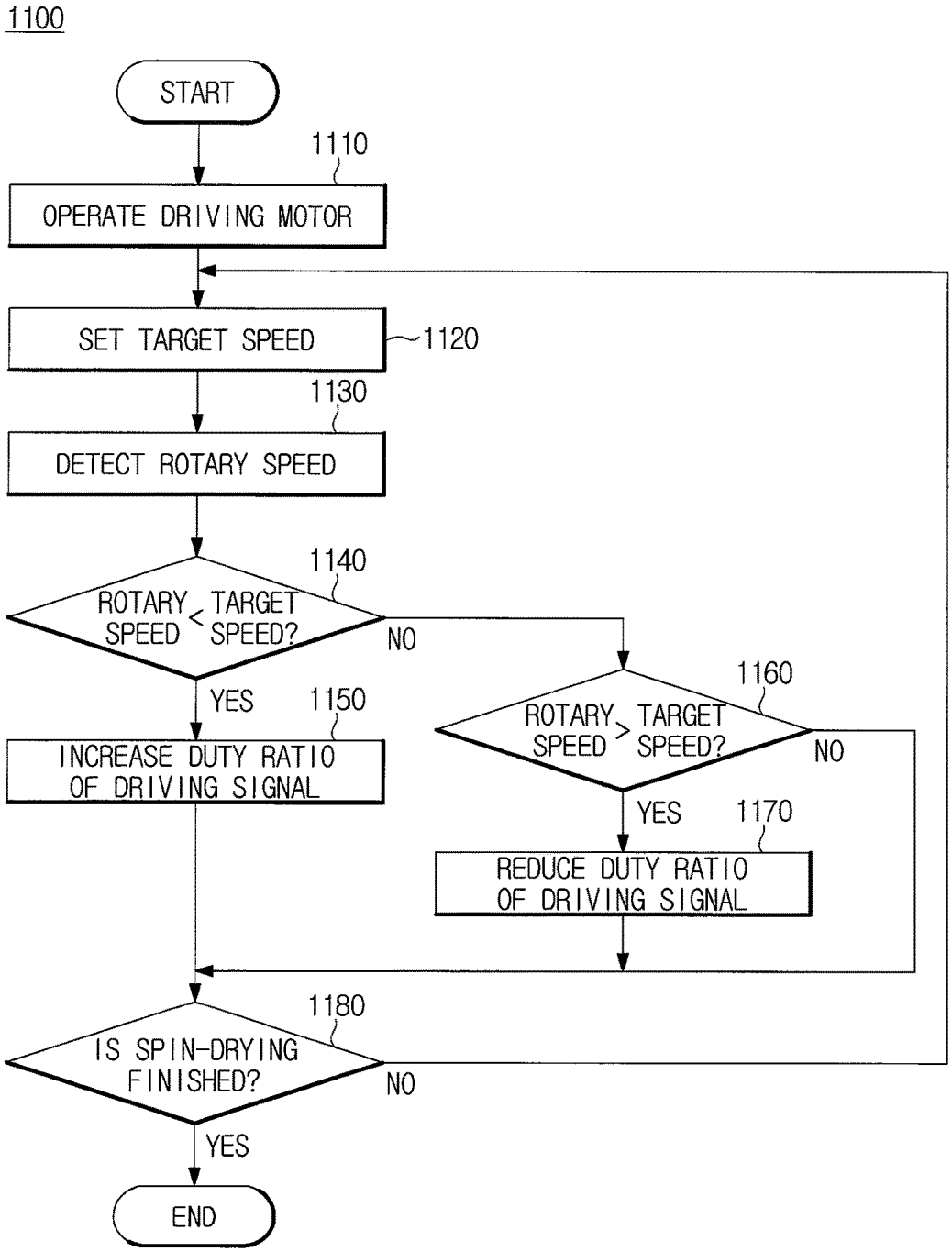
FIG. 11 is a flowchart illustrating an example of a method in which washing machine controls the rotary speed of the rotating tub in accordance with one embodiment of the present disclosure.
Figure 12:
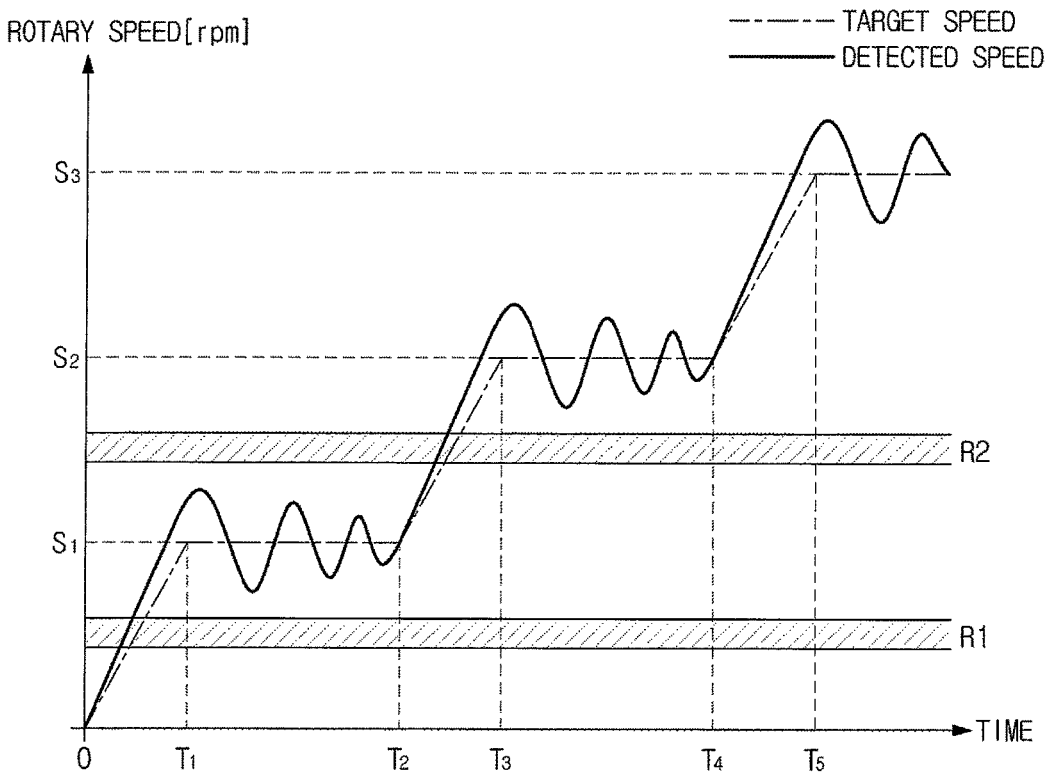
FIG. 12 illustrates the rotary speed of the rotating tub when the driving motor is controlled according to the method shown in FIG. 11.

FIG. 11 is a flowchart illustrating an example of the method in which the washing machine 1 controls the rotary speed of the rotating tub 30 in accordance with one embodiment of the present disclosure. FIG. 12 illustrates the rotary speed of the rotating tub 30 when the driving motor 80 is controlled according to the method shown in FIG. 11.

Referring to FIGS. 11 and 12, a method 1100 in which the washing machine 1 controls the rotary speed of the rotating tub 30 during the spin-drying operation will be described.

When the spin-drying operation begins, the washing machine operates the driving motor 80 (S1110).

Here, the washing machine 1 maintains the clutch assembly 100 in the spin-drying mode to allow the torque of the driving motor 80 to be supplied to the rotating tub 30 and the pulsator 40. In other words, during the intermittent spin-drying, the controller 210 operates the drainage motor 73.

Also, the controller 210 turns on the driving switch unit 241 of the motor driver 240 to allow the power of the external power supply PS to be supplied to the driving motor 80. When the driving switch unit 241 is turned on, the power of the external power supply PS is supplied to the driving motor 80 and the driving motor 80 rotates.

The washing machine 1 sets the target speed of the rotating tub 30 (S1120).

As described above, the target speed of the rotating tub 30 can be preset by the designer for the washing machine 1 and stored in the memory 213 of the controller 210.

Here, the target speed can vary as the spin-drying operation has been performed. For example, as shown in FIG. 12, the target speed can increase to a first target speed S1 between a point in time of beginning of the spin-drying operation and a first point in time T1 and can be maintained at the first target speed S1 from the point in time T1 to a second point in time T2. Also, the target speed can increase to a second target speed S2 between the second point in time T2 and a third point in time T3 and can be maintained at the second target speed S2 between the third point in time T3 and a fourth point in time T4. Also, the target speed can increase to a third target speed S3 between the third point in time T3 and the fourth point in time T4 and can be maintained at the third target speed S3 after the fourth point in time T4.

The controller 210 can set the target speed by loading a target speed corresponding to a time in which the spin-drying operation is performed from the memory 213.

The washing machine 1 detects the rotary speed of the rotating tub 30 (S1130).

The controller 210 of the washing machine 1 detects rotary speeds of the clutch assembly 100 and the rotating tub 30 based on an electric signal output by the speed detector 230.

As described above, in the spin-drying mode of the clutch assembly 100, the clutch assembly 100 transfers the torque provided from the driving motor 80 to the rotating tub 30 and the pulsator 40 as it is. Accordingly, the controller 210 can detect the rotary speed of the clutch assembly 100 using the speed detector 230 to detect the rotary speed of the rotating tub 30.

Also, due to a difference between the diameters of the driving pulley 91 and the driven pulley 93, the rotary speed of the driving motor 80 and the rotary speed of the clutch assembly 100 can differ from each other. In other words, the controller 210 can calculate the rotary speeds of the clutch assembly 100 and the rotating tub 30 using a ratio of the diameter of the driving pulley 91 to the diameter of the driven pulley 93 and the rotary speed of the driving motor 80. Accordingly, the controller 210 can detect the rotary speed of the driving motor 80 to detect the rotary speed of the rotating tub 30.

The washing machine 1 determines whether the rotary speed of the rotating tub 30 is less than the target speed (S1140).

The controller 210 of the washing machine 1 can compare the rotary speed of the rotating tub 30 with the target speed set in S1120 and can determine whether the rotary speed of the rotating tub 30 is smaller than the target speed.

When the rotary speed of the rotating tub 30 is determined to be less than the target speed (Yes in S1140), the washing machine 1 increases the duty ratio of the driving signal (S1150).

When the rotary speed of the rotating tub 30 is less than the target speed, the controller 210 of the washing machine 1 increases the power supplied to the driving motor 80 to increase the rotary speed of the rotating tub 30. In detail, the controller 210 can reduce the turn-off time Toff in which the driving switch unit 241 is turned off and can increase the turn-on time Ton in which the driving switch unit 241 is turned on.

In other words, the controller 210 can increase a turn-on time duty ratio of the driving signal for controlling the motor driver 240.

The washing machine 1 determines whether the spin-drying operation is finished (S1180).

In detail, the controller 210 of the washing machine 1 can compare a time in which the spin-drying operation is performed with a spin-drying time input by the user and can finish the spin-drying operation when the time in which the spin-drying operation is performed is greater than the spin-drying time.

When the spin-drying operation is determined to be finished (Yes in S1180), the washing machine 1 stops the operation. When the spin-drying operation is not determined to be finished (No in S1180), the washing machine 1 resets the target speed depending on the time of performing the spin-drying operation (S1120).

Also, when the rotary speed of the rotating tub 30 is determined to be not less than the target speed (No in S1140), the washing machine 1 determines whether the rotary speed of the rotating tub 30 exceeds the target speed (S1160).

The controller 210 of the washing machine 1 can compare the rotary speed of the rotating tub 30 with the target speed set in S1120 and can determine whether the rotary speed of the rotating tub 30 is greater than the target speed.

When the rotary speed of the rotating tub 30 is determined to be more than the target speed (Yes in S1160), the washing machine 1 reduces the duty ratio of the driving signal (S1170).

When the rotary speed of the rotating tub 30 exceeds the target speed, the controller 210 of the washing machine 1 reduces the power supplied to the driving motor 80 to reduce the rotary speed of the rotating tub 30. In detail, the controller 210 can increase the turn-off time Toff in which the driving switch unit 241 is turned off and can reduce the turn-on time Ton in which the driving switch unit 241 is turned on.

In other words, the controller 210 can reduce the turn-on time duty ratio of the driving signal for controlling the motor driver 240.

The washing machine 1 determines whether the spin-drying operation is finished (S1180). After that, the operation of the washing machine 1 is the same as described above.

When the rotary speed of the rotating tub 30 is not determined to be more than the target speed (No in S1160), the washing machine 1 determines whether the spin-drying operation is finished (S1180).

When the rotary speed of the rotating tub 30 is not greater or smaller than the target speed, the controller 210 can determine the rotary speed of the rotating tub 30 to be identical to the target speed. Accordingly, the controller 210 does not change the duty ratio of the driving signal.

According to the phase angle control method 1100 in the washing machine 1 described above, the rotary speed of the rotating tub 30 can vary as shown in FIG. 12. In other words, the rotary speed of the rotating tub 30 can gradually arrive at the target speed while fluctuating.

Particularly, when the first target speed 51 is set as a rotary speed between the first resonance area R1 and the second resonance area R2 and the second target speed S2 is set to be greater than the second resonance area R2, the rotary speed of the rotating tub 30 passes the first resonance area R1 and the second resonance area R2 once as shown in FIG. 12.

Next, it will be described that the washing machine 1 controls the rotary speed of the rotating tub 30 using "hysteresis control".

Figures 13A, 13B, 13C:
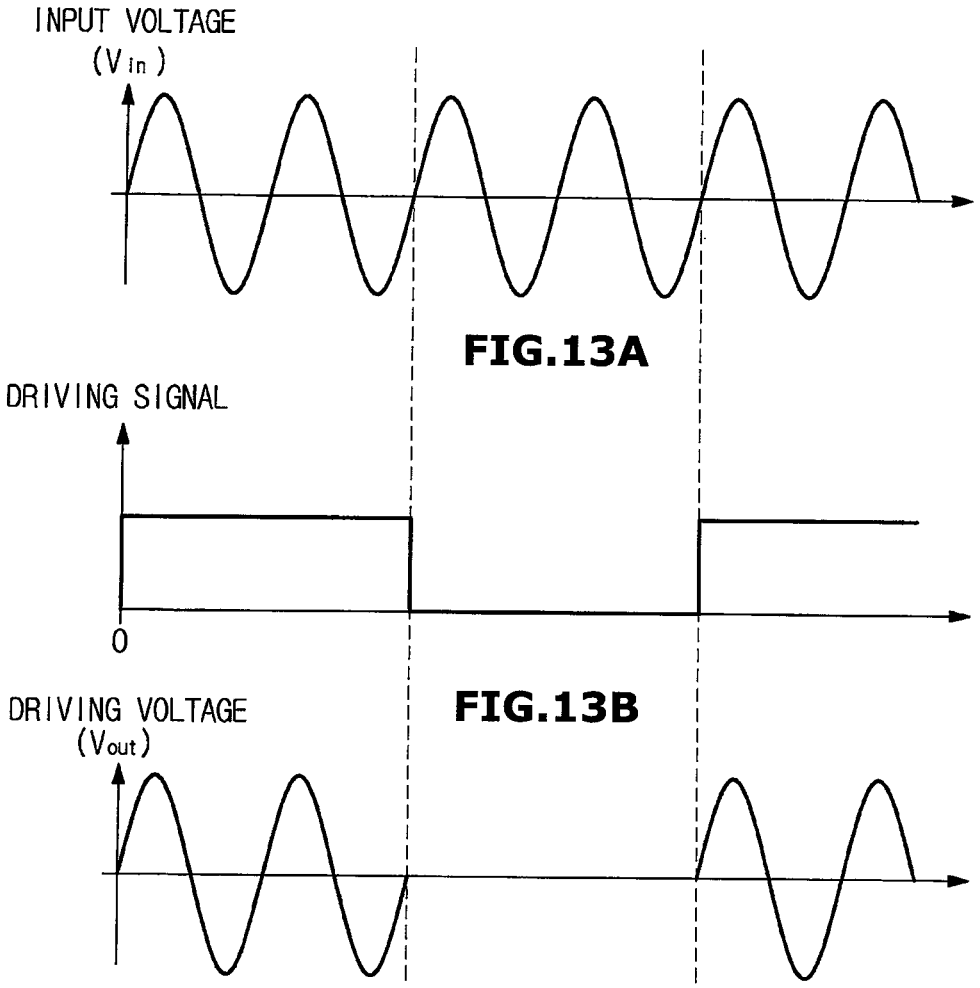
FIGS. 13A to 13C are views illustrating that the washing machine in accordance with one embodiment of the present disclosure controls the rotary speed of the rotating tub.

FIGS. 13A to 13C are views illustrating that the washing machine 1 in accordance with one embodiment of the present disclosure controls the rotary speed of the rotating tub 30.

The external power supply PS supplies an input voltage Vin to the washing machine 1 as shown in FIG. 13A. Here, the input voltage Vin input from the external power supply PS can be AC voltage which has a frequency of 50 Hz or 60 Hz and a voltage of 110 V or 220 V.

The controller 210 of the washing machine 1 can determine whether the rotary speed detected by the speed detector 230 is within a certain speed range and can operate the driving motor 80 or stop the operating of the driving motor 80 when the rotary speed is out of the certain speed range. Here, the certain speed range can be set based on the target speed.

In detail, when the rotary speed of the rotating tub 30 is greater than the certain speed range, the controller 210 turns off the driving switch unit 241 of the motor driver 240 to stop the operating of the driving motor 80. Also, when the rotary speed of the rotating tub 30 is smaller than the certain speed range, the controller 210 turns on the driving switch unit 241 to operate the driving motor 80.

Particularly, a driving signal of turning on or turning off the driving switch unit 241, as shown in FIG. 12B, can be synchronized with a point in time when the voltage of the input voltage Vin becomes "0" (hereinafter, referred to as "zero crossing"). In other words, when the zero crossing is detected, the controller 210 can switch the driving signal from ON to OFF or can switch the driving signal from OFF to ON.

As described above, when the driving signal is switched using the zero crossing, it is possible to lighten a burden on the driving switch unit 241 to cut off a high voltage input from the external power supply PS.

According to the driving signal shown in FIG. 13B, a driving voltage Vout shown in FIG. 13C is supplied to the driving motor 80.

According to "the hysteresis control" described above, supplying the power and cutting off the power from the external power supply PS to the driving motor 80 are repetitively performed. Depending on the supplying of the power and the cutting off the power, the rotary speed of the driving motor 80 varies.

Hereinafter, a method in which the washing machine 1 controls the rotary speed of the rotating tub 30 using "hysteresis control" will be described in detail.

Figure 14:
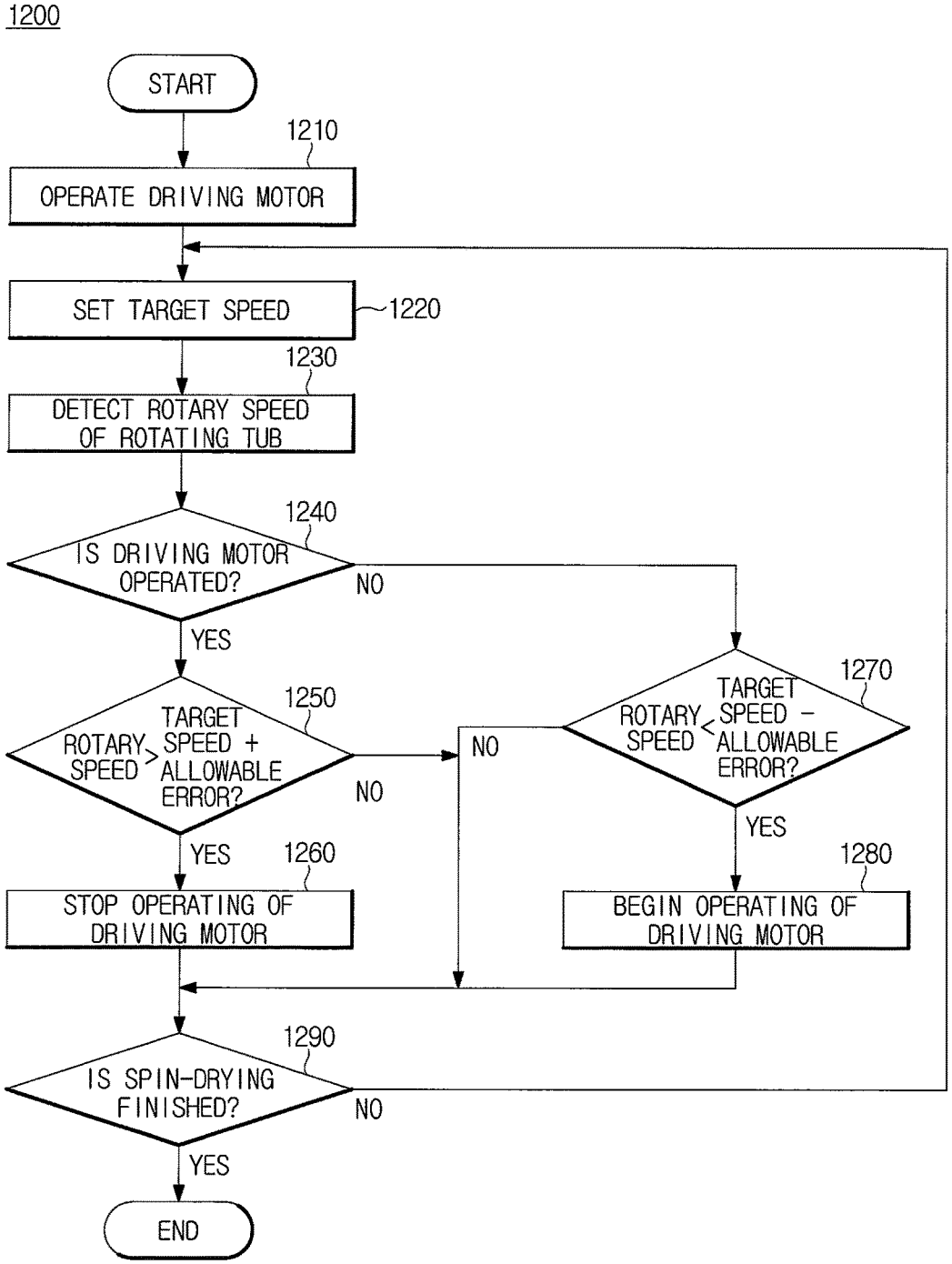
FIG. 14 is a flowchart illustrating another example of the method of controlling the rotary speed of the rotating tub by the washing machine in accordance with one embodiment of the present disclosure.
Figure 15:
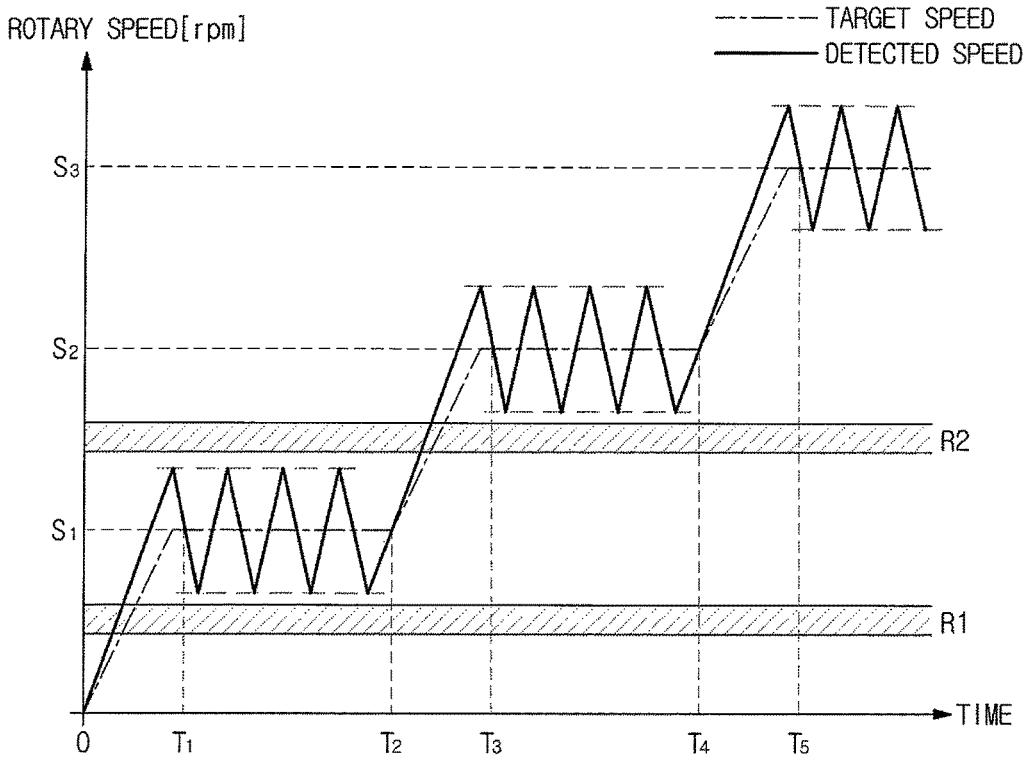
FIG. 15 illustrates the rotary speed of the rotating tub when the driving motor is controlled according to the method shown in FIG. 14.

FIG. 14 is a flowchart illustrating another example of the method of controlling the rotary speed of the rotating tub 30 by the washing machine 1 in accordance with one embodiment of the present disclosure. FIG. 15 illustrates the rotary speed of the rotating tub 30 when the driving motor 80 is controlled according to the method shown in FIG. 14.

Referring to FIGS. 14 and 15, a method 1200 in which the washing machine 1 controls the rotary speed of the rotating tub 30 during the spin-drying operation will be described.

When the spin-drying operation begins, the washing machine 1 operates the driving motor 80 (S1210).

Here, the washing machine 1 maintains the clutch assembly 100 in a spin-drying mode to allow the torque of the driving motor 80 to be supplied to the rotating tub 30 and the pulsator 40. In other words, during the intermittent spin-drying, the controller 210 operates the drainage motor 73.

Also, the controller 210 turns on the driving switch unit 241 of the motor driver 240 to allow the power of the external power supply PS to be supplied to the driving motor 80. When the driving switch unit 241 is turned on, the power of the external power supply PS is supplied to the driving motor 80 and the driving motor 80 rotates.

The washing machine 1 sets the target speed of the rotating tub 30 (S1220).

As described above, the target speed of the rotating tub 30 can be preset by the designer for the washing machine 1 and stored in the memory 213 of the controller 210.

Here, the target speed can vary as the spin-drying operation has been performed. For example, as shown in FIG. 15, the target speed can increase to a first target speed S1 between a point in time of beginning of the spin-drying operation and a first point in time T1 and can be maintained at the first target speed S1 from the point in time T1 to a second point in time T2. Also, the target speed can increase to a second target speed S2 between the second point in time T2 and a third point in time T3 and can be maintained at the second target speed S2 between the third point in time T3 and a fourth point in time T4. Also, the target speed can increase to a third target speed S3 between the third point in time T3 and the fourth point in time T4 and can be maintained at the third target speed S3 after the fourth point in time T4.

The controller 210 can set the target speed by loading a target speed corresponding to a time in which the spin-drying operation is performed from the memory 213.

The washing machine 1 detects the rotary speed of the rotating tub 30 (S1230).

The controller 210 of the washing machine 1 detects rotary speeds of the clutch assembly 100 and the rotating tub 30 based on an electric signal output by the speed detector 230.

As described above, in the spin-drying mode of the clutch assembly 100, the clutch assembly 100 transfers the torque provided from the driving motor 80 to the rotating tub 30 and the pulsator 40 as it is. Accordingly, the controller 210 can detect the rotary speed of the clutch assembly 100 to detect the rotary speed of the rotating tub 30.

Also, due to the difference between the diameters of the driving pulley 91 and the driven pulley 93, the rotary speed of the driving motor 80 and the rotary speed of the clutch assembly 100 can differ from each other. In other words, the controller 210 can calculate the rotary speeds of the clutch assembly 100 and the rotating tub 30 using the ratio of the diameter of the driving pulley 91 to the diameter of the driven pulley 93 and the rotary speed of the driving motor 80. Accordingly, the controller 210 can detect the rotary speed of the driving motor 80 to detect the rotary speed of the rotating tub 30.

The washing machine 1 determines whether the driving motor 80 is operating (S1240).

The controller 210 of the washing machine 1 can determine whether the driving motor 80 is operating using various methods.

For example, it is possible to determine whether the driving motor 80 is operating, based on the driving signal output to the motor driver 240. In detail, when the driving signal is an ON signal for turning on the driving switch unit 241, the controller 210 can determine the driving motor 80 as operating. Also, when the driving signal is an OFF signal for turning off the driving switch unit 241, the controller 210 can determine the operating of the driving motor 80 as being stopped.

As another example, the controller 210 can store operation information of the driving motor 80 when operating the driving motor 80 or stopping the operating of the driving motor 80 in the memory 213 in the controller 210 and can determine whether the driving motor 80 is operating, based on the operation information stored in the memory 213.

In detail, the controller 210 can store the operating of the driving motor 80 in the memory 213 when the driving motor 80 is operated and can store the stopping the operating of the driving motor 80 in the memory 213 when the operating of the driving motor 80 is stopped. After that, the controller 210 can determine that the driving motor 80 is operating when the operating of the driving motor 80 is stored in the memory 213 and can determine that the operating of the driving motor 80 is stopped when the stopping the operating of the driving motor 80 is stored in the memory 213.

When the driving motor 80 is operating (Yes in S1240), the washing machine 1 determines whether the rotary speed of the rotating tub 30 is greater than a sum of the target speed and an allowable error (S1250).

The controller 210 of the washing machine 1 can compare the rotary speed of the rotating tub 30 with the sum of the target speed and the allowable error set in S1220 and can determine whether the rotary speed of the rotating tub 30 is greater than the sum of the target speed and the allowable error. Here, the allowable error can be set by considering the target speed and vibration caused by operating or stopping the driving motor 80.

When the rotary speed of the rotating tub 30 is determined to be more than the sum of the target speed and the allowable error (Yes in S1250), the washing machine 1 stops the operating of the driving motor 80 (S1260).

The controller 210 cuts off the power supplied to the driving motor 80 to reduce the rotary speed of the rotating tub 30. In detail, the controller 210 can output the driving signal for turning off the driving switch unit 241.

The washing machine 1 determines whether the spin-drying operation is finished (S1290).

In detail, the controller 210 of the washing machine 1 can compare a time in which the spin-drying operation is performed with a spin-drying time input by the user and can finish the spin-drying operation when the time in which the spin-drying operation is performed is greater than the spin-drying time.

When the spin-drying operation is determined to be finished (Yes in S1290), the washing machine 1 stops the operation. When the spin-drying operation is not determined to be finished (No in S1290), the washing machine 1 resets the target speed depending on the time in which the spin-drying operation is performed (S1220).

Also, when the rotary speed of the rotating tub 30 is not determined to be more than the sum of the target speed and the allowable error (No in S1250), the washing machine 1 determines whether the spin-drying operation is finished (S1290). After that, the operation of the washing machine 1 is identical as described above.

When the driving motor 80 is not operating (No in S1240), the washing machine 1 determines whether the rotary speed of the rotating tub 30 is smaller than a difference between the target speed and the allowable error (S1270).

The controller 210 of the washing machine 1 can compare the rotary speed of the rotating tub 30 with the difference between the target speed set in S1220 and the allowable error and can determine whether the rotary speed of the rotating tub 30 is smaller than the difference between the target speed and the allowable error. Here, the allowable error can be set by considering the target speed and vibration caused by operating or stopping the driving motor 80.

When the rotary speed of the rotating tub 30 is determined to be smaller than the difference between the target speed and the allowable error (Yes in S1270), the washing machine 1 operates the driving motor 80 (S1280).

The controller 210 supplies the power to the driving motor 80 to increase the rotary speed of the rotating tub 30. In detail, the controller 210 can output the driving signal for turning on the driving switch unit 241.

The washing machine 1 determines whether the spin-drying operation is finished (S1290). After that, the operation of the washing machine 1 is the same as described above.

Also, when the rotary speed of the rotating tub 30 is not determined to be smaller than the difference between the target speed and the allowable error (No in S1270), the washing machine 1 determines whether the spin-drying operation is finished (S1290). After that, the operation of the washing machine 1 is the same as described above.

According to the hysteresis control method 1200 in the washing machine 1 described above, the rotary speed of the rotating tub 30 can vary as shown in FIG. 15. In other words, the rotary speed of the rotating tub 30 fluctuates around the target speed.

As described above, the method in which the washing machine 1 controls the rotary speed of the rotating tub 30 during the spin-drying operation has been described.

Hereinafter, a method of reducing noise caused by the clutch assembly 100 and abrasion of the clutch assembly 100 during the spin-drying operation will be described.

Figure 16:
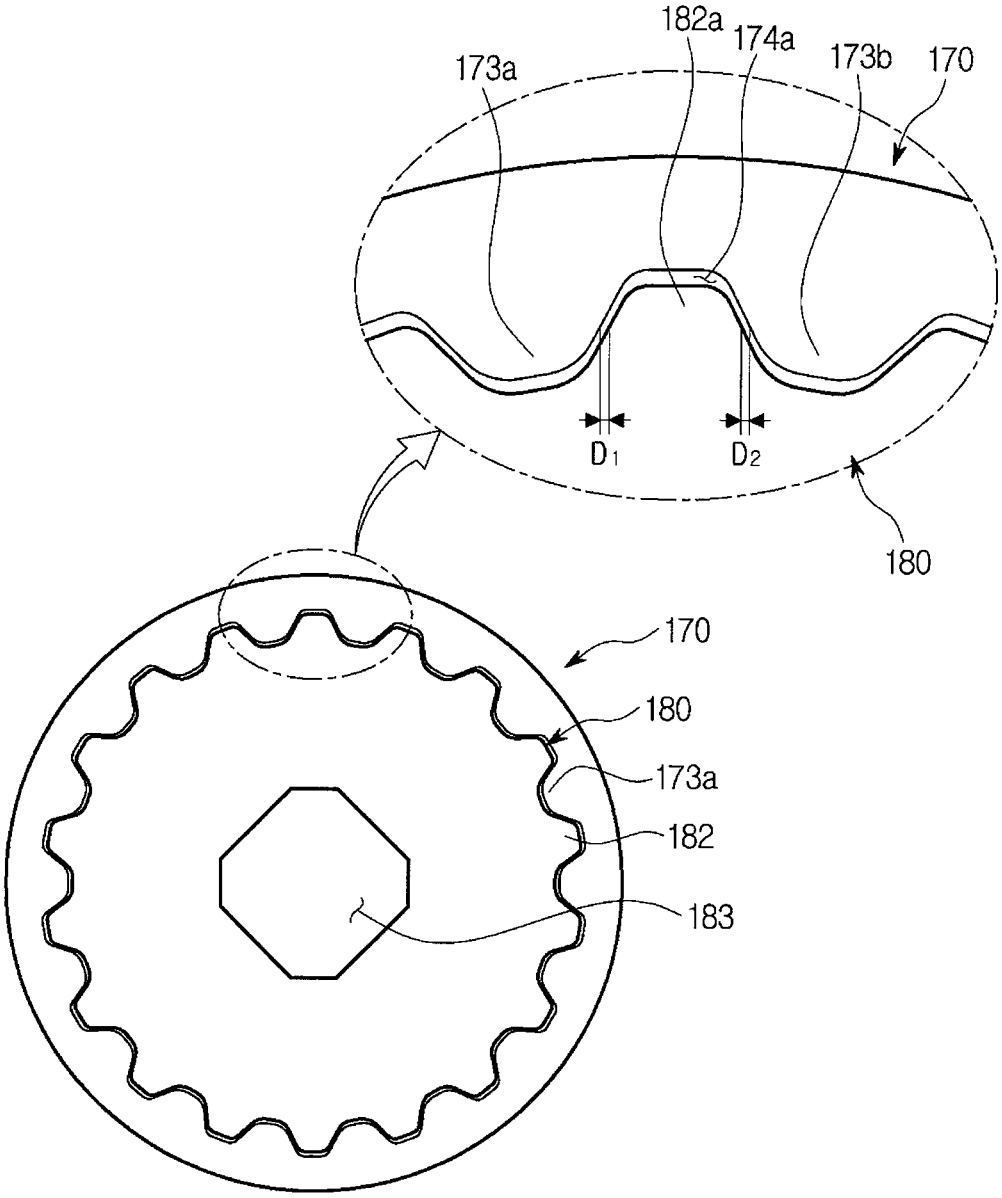
FIG. 16 is a cross-sectional view illustrating the clutch boss and the clutch coupling of the clutch assembly included in the washing machine in accordance with one embodiment of the present disclosure.
Figure 17:
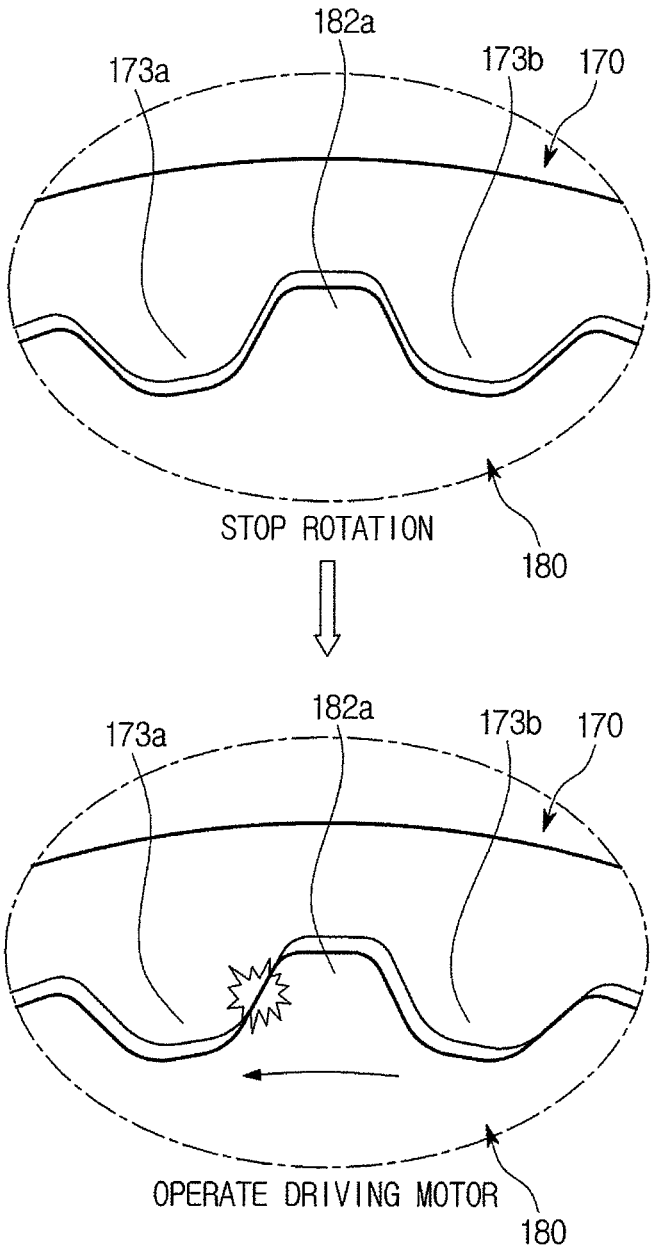
FIGS. 17 and 18 are cross-sectional views illustrating the clutch boss and the clutch coupling when the washing machine in accordance with one embodiment of the present disclosure operates the driving motor.
Figure 18:
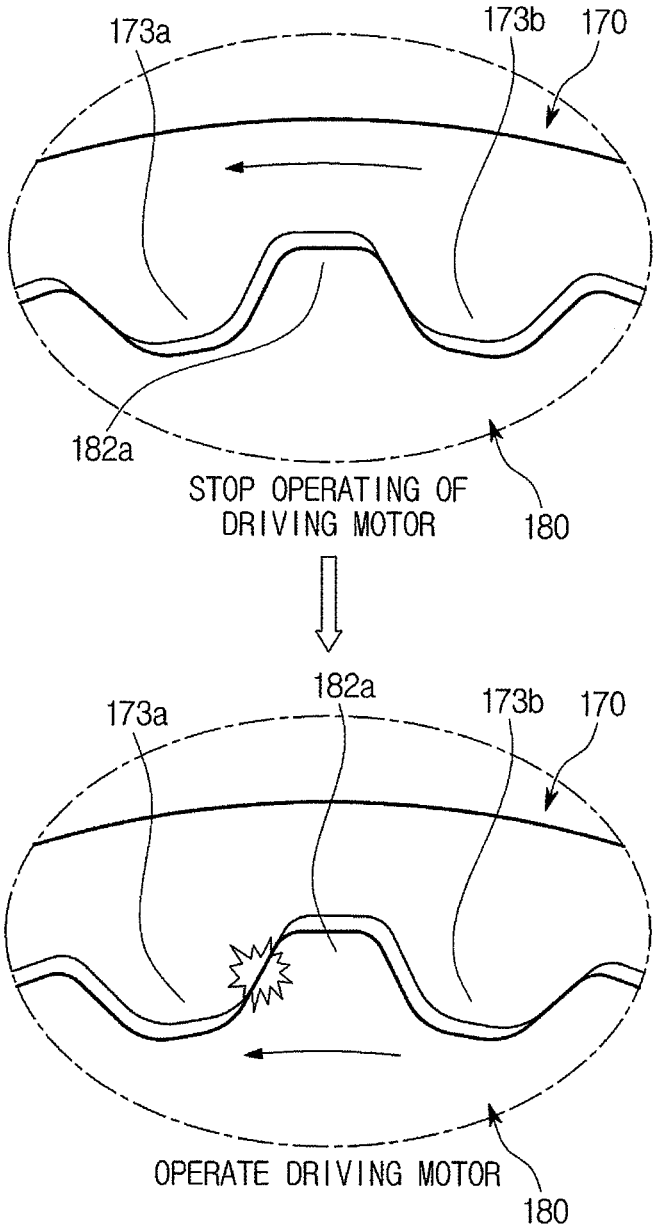

FIG. 16 is a cross-sectional view illustrating the clutch boss 180 and the clutch coupling 170 of the clutch assembly 100 included in the washing machine 1 in accordance with one embodiment of the present disclosure. FIGS. 17 and 18 are cross-sectional views illustrating the clutch boss 180 and the clutch coupling 170 when the washing machine 1 in accordance with one embodiment of the present disclosure operates the driving motor 80.

When the clutch assembly 100 operates in the spin-drying mode, as shown in FIG. 16, the boss protrusions 182 of the clutch boss 180 are inserted into the coupling grooves 174 of the clutch coupling 170, thereby coupling the clutch boss 180 with the clutch coupling 170. For example, as shown in an enlarged part in FIG. 16, a first boss protrusion 182*a* is inserted into a first coupling groove 174*a* formed between first coupling protrusion 173*a* and a second coupling protrusion 173*b*.

To allow the clutch boss 180 and the clutch coupling 170 to be smoothly coupled with each other, widths of the coupling grooves 174 are greater than widths of the boss protrusions 182. As a result, gaps are present between the boss protrusions 182 and the coupling protrusions 173. For example, as shown in the enlarged part in FIG. 16, a first gap D1 is present between the first boss protrusion 182*a* and the first coupling protrusion 173*a* and a second gap D2 is present between the first boss protrusion 182*a* and the second coupling protrusion 173*b*. The gaps D1 and D2 described above cause abrasions of the boss protrusions 182 and coupling protrusions 173 and noise.

When the driving motor 80 is not operated and the clutch assembly 100 does not rotate, for example, before the spin-drying operation is performed, the boss protrusions 182 and the coupling protrusions 173 maintain certain intervals therebetween.

Here, when the driving motor 80 is operated, due to the torque transferred from the driving motor 80, the boss protrusions 182 apply impacts to the coupling protrusions 173. For example, as shown in FIG. 17, when counterclockwise torque is transferred to the clutch boss 180, the first boss protrusion 182*a* applies an impact to the first coupling protrusion 173*a* due to the torque, noise occurs due to collision between the first boss protrusion 182*a* and the first coupling protrusion 173*a*, and the first boss protrusion 182*a* and the first coupling protrusion 173*a* wear and tear.

Also, when the driving motor 80 is not operated and the clutch assembly 100 rotates, for example, the operating of the driving motor 80 is stopped while the rotating tub 30 rotates during the spin-drying operation, the boss protrusions 182 are in contact with the coupling protrusions 173 in a direction opposite to the rotation and maintain certain intervals from the coupling protrusions 173 in a rotation direction. For example, when the rotating tub 30 rotates counterclockwise, as shown in FIG. 18, the first boss protrusion 182*a* is in contact with the second coupling protrusion 173*b* and maintains a certain interval from the coupling protrusion 173*a*.

Here, when the driving motor 80 is operated, due to the torque transferred from the driving motor 80, the boss protrusions 182 apply impacts to the coupling protrusions 173. For example, as shown in FIG. 18, when counterclockwise torque is transferred to the clutch boss 180, the first boss protrusion 182*a* applies an impact to the first coupling protrusion 173*a* due to the torque, noise occurs due to collision between the first boss protrusion 182*a* and the first coupling protrusion 173*a*, and the first boss protrusion 182*a* and the first coupling protrusion 173*a* wear and tear.

As described above, not only when the rotation of the rotating tub 30 begins during the spin-drying operation but also whenever the driving motor 80 repetitively operates and stops while the rotating tub 30 rotates, the boss protrusions 182 and the coupling protrusions 173 collide with each other.

To minimize the impact when the boss protrusions 182 and the coupling protrusions 173 collide with each other, the washing machine 1 can gradually increase the torque of the driving motor 80 when beginning the operating of the driving motor 80.

Figure 19:
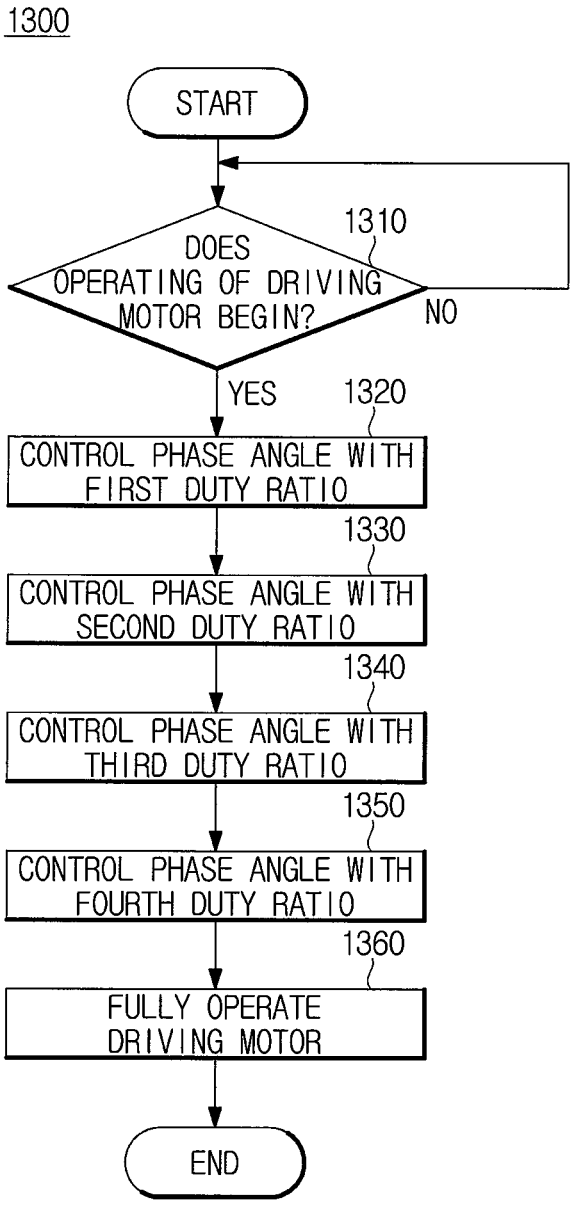
FIG. 19 is a flowchart illustrating an example of a method of controlling torque of the driving motor by the washing machine in accordance with one embodiment of the present disclosure.
Figures 20A, 20B, 20C:
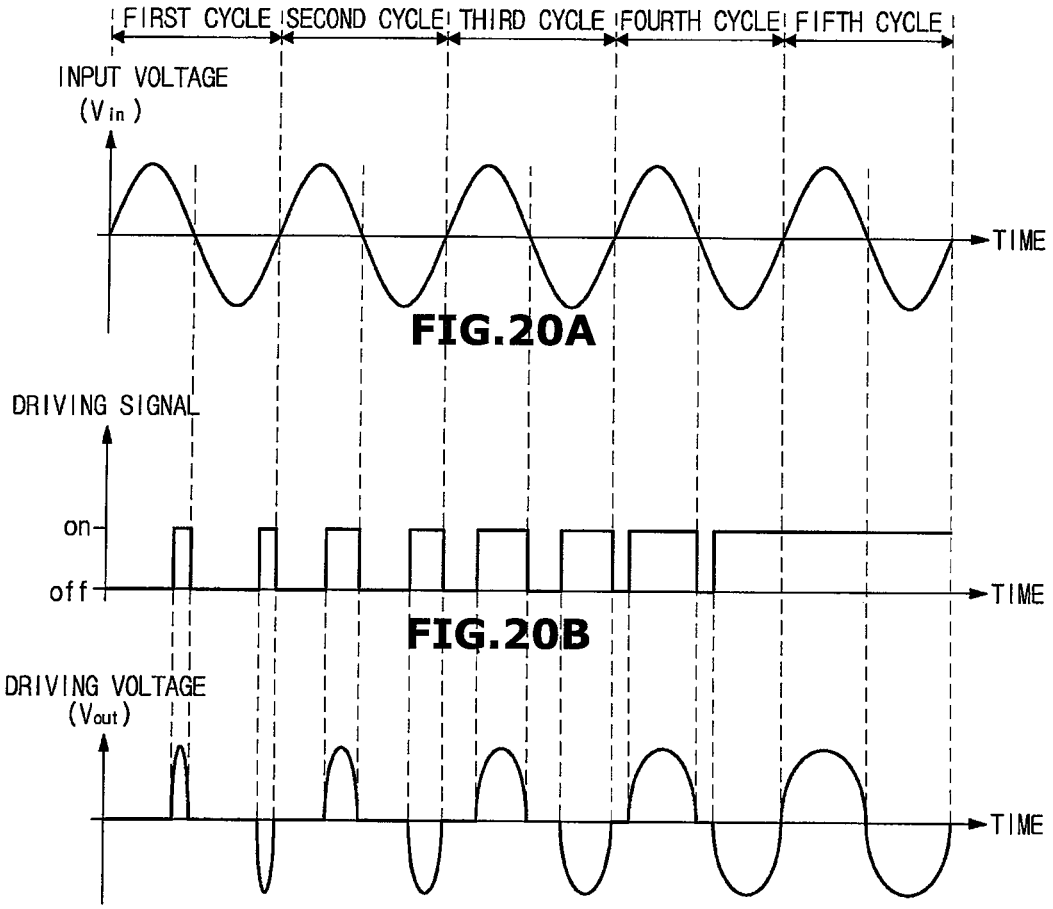
FIGS. 20A to 20C illustrate an example of a driving voltage supplied to the driving motor according to the method shown in FIG. 19.

FIG. 19 is a flowchart illustrating an example of a method of controlling the torque of the driving motor 80 by the washing machine 1 in accordance with one embodiment of the present disclosure. FIGS. 20A to 20C illustrate an example of a driving voltage supplied to the driving motor 80 according to the method shown in FIG. 19.

Referring to FIGS. 19 to 20C, the washing machine 1 determines whether to operate the driving motor 80 (S1310).

The controller 210 of the washing machine 1 can operate the driving motor 80 in various cases.

For example, when the spin-drying operation of the washing machine 1, which includes the intermittent spin-drying, begins, the controller 210 can operate the driving motor 80. Also, when the rotary speed of the rotating tub 30 is smaller than the difference between the target speed and the allowable error during the spin-drying operation, the controller 210 can operate the driving motor 80.

In other words, the controller 210 can operate the driving motor 80 not only to begin the rotating of the rotating tub 30 but also to maintain the rotary speed of the rotating tub 30.

When it is not determined to operate the driving motor 80 (No in S1310), the washing machine 1 continues an existing operation.

Also, when it is determined to operate the driving motor 80 (Yes in S1310), the washing machine 1 performs the phase angle control with a first duty ratio on the power supplied to the driving motor 80 (S1320).

As described above, "the phase angle control" is controlling a phase angle of the power supplied to the driving motor 80. In other words, according to "the phase angle control", the washing machine 1 supplies only the part of the power supplied from the external power supply PS to the driving motor 80.

Here, the first duty ratio can be set as various values.

For example, the first duty ratio can be set as 0.2 (20%). When the first duty ratio is set as 0.2, as shown in a first cycle in FIG. 20, the controller 210 can output a driving signal with a duty ratio of 0.2 to the motor driver 240. As a result, a driving voltage shown in the first cycle in FIG. 20 is supplied to the driving motor 80 and power of about 20% of input power supplied from the external power supply PS is supplied to the driving motor 80.

After that, the washing machine 1 performs the phase angle control with a second duty ratio on the power supplied to the driving motor 80 (S1330).

Here, the second duty ratio can be set as a greater value than the first duty ratio.

For example, the second duty ratio can be set as 0.4 (40%). When the second duty ratio is set as 0.4, as shown in a second cycle in FIG. 20, the controller 210 can output a driving signal with a duty ratio of 0.4 to the motor driver 240. As a result, a driving voltage shown in the second cycle in FIG. 20 is supplied to the driving motor 80 and power of about 40% of the input power supplied from the external power supply PS is supplied to the driving motor 80.

After that, the washing machine 1 performs the phase angle control with a third duty ratio on the power supplied to the driving motor 80 (S1340).

Here, the third duty ratio can be set as a greater value than the first duty ratio and the second duty ratio.

For example, the third duty ratio can be set as 0.6 (60%). When the third duty ratio is set as 0.6, as shown in a third cycle in FIG. 20, the controller 210 can output a driving signal with a duty ratio of 0.6 to the motor driver 240. As a result, a driving voltage shown in the third cycle in FIG. 20 is supplied to the driving motor 80 and power of about 60% of the input power supplied from the external power supply PS is supplied to the driving motor 80.

After that, the washing machine 1 performs the phase angle control with a fourth duty ratio on the power supplied to the driving motor 80 (S1350).

Here, the fourth duty ratio can be set as a greater value than the first duty ratio, the second duty ratio, and the third duty ratio.

For example, the fourth duty ratio can be set as 0.8 (80%). When the fourth duty ratio is set as 0.8, as shown in a fourth cycle in FIG. 20, the controller 210 can output a driving signal with a duty ratio of 0.8 to the motor driver 240. As a result, a driving voltage shown in the fourth cycle in FIG. 20 is supplied to the driving motor 80 and power of about 80% of the input power supplied from the external power supply PS is supplied to the driving motor 80.

After that, the washing machine 1 supplies the whole power supplied from the external power supply PS to the driving motor 80 (S1360).

The controller 210 of the washing machine 1 can output a driving signal with 1 (100%) to the motor driver 240. As a result, as shown in a fifth cycle in FIG. 20, a driving voltage identical to an input voltage is supplied to the driving motor 80.

However, the method of controlling the torque of the driving motor 80 is not limited to the method described above.

Figure 21:
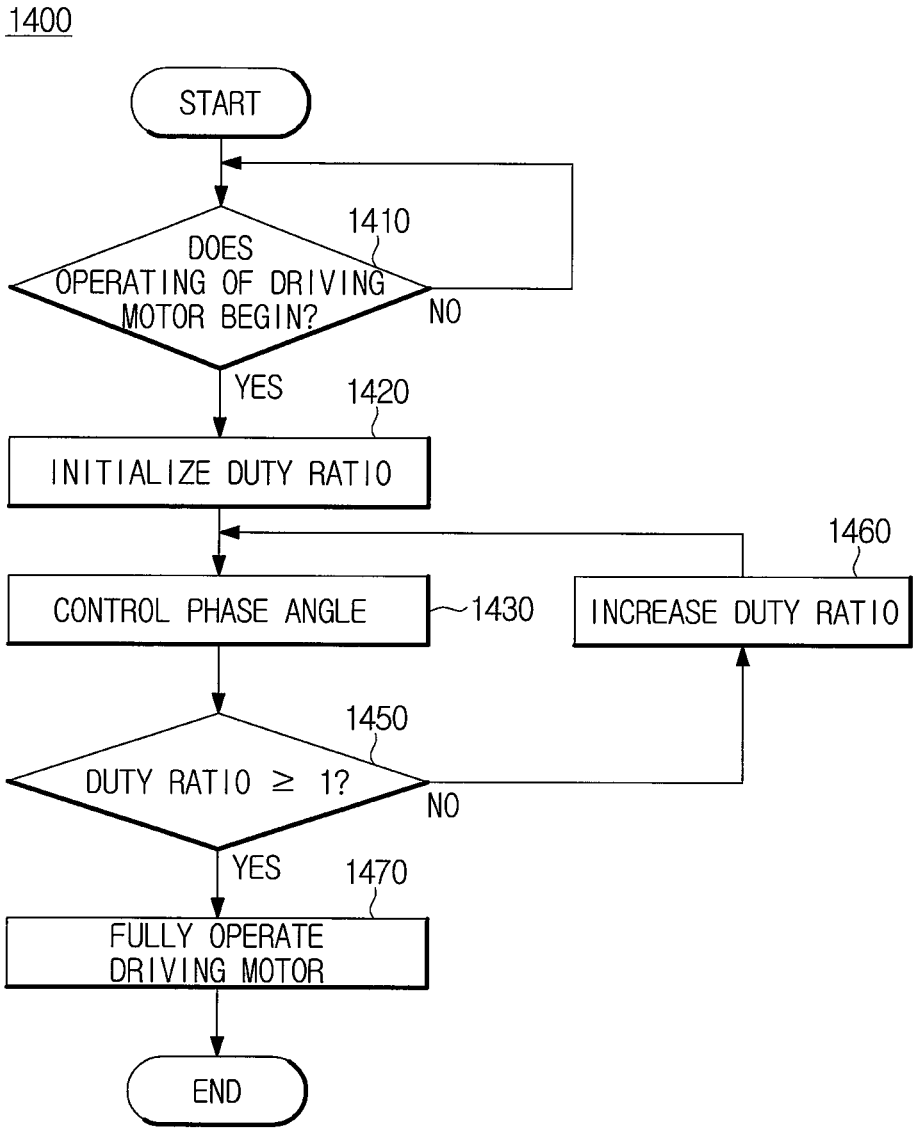
FIG. 21 is a flowchart illustrating another example of the method of controlling the torque of the driving motor by the washing machine in accordance with one embodiment of the present disclosure.

FIG. 21 is a flowchart illustrating another example of the method of controlling the torque of the driving motor 80 by the washing machine 1 in accordance with one embodiment of the present disclosure.

Referring to FIG. 21, the washing machine 1 determines whether to operate the driving motor 80 (S1410).

The controller 210 of the washing machine 1 can operate the driving motor 80 in various cases.

For example, when the spin-drying operation of the washing machine 1, which includes the intermittent spin-drying, begins, the controller 210 can operate the driving motor 80. Also, when the rotary speed of the rotating tub 30 is smaller than the difference between the target speed and the allowable error during the spin-drying operation, the controller 210 can operate the driving motor 80.

In other words, the controller 210 can operate the driving motor 80 not only to begin the rotating of the rotating tub 30 but also to maintain the rotary speed of the rotating tub 30.

When it is not determined to operate the driving motor 80 (No in S1410), the washing machine 1 continues an existing operation.

Also, when it is determined to operate the driving motor 80 (Yes in S1410), the washing machine 1 initializes a duty ratio (S1420).

The controller 210 of the washing machine 1 can input an initial value 에 the duty ratio. Here, the initial value can be "0".

After that, the washing machine 1 performs the phase angle control (S1430).

The controller 210 of the washing machine 1 performs the phase angle control on the power supplied to the driving motor 80 based on the duty ratio previously set.

As described above, "the phase angle control" is controlling the phase angle of the power supplied to the driving motor 80. In other words, according to "the phase angle control", the washing machine 1 supplies only the part of the power supplied from the external power supply PS to the driving motor 80.

After that, the washing machine 1 determines whether the duty ratio is "1 (100%)" or more (S1450).

The controller 210 of the washing machine 1 can determine whether the duty ratio is "1 (100%)" or more by comparing the duty ratio previously set with "1".

When the duty ratio is not "1 (100%)" or more (No in S1450), the washing machine 1 increases the duty ratio.

Since the driving motor 80 of the washing machine 1 is not fully operated when the duty ratio is not "1 (100%)" or more, the controller 210 of the washing machine 1 increases the duty ratio by a predetermined value. For example, the controller 210 can increase the duty ratio by 0.2 (20%).

After that, the washing machine 1 performs the phase angle control again.

Also, when the duty ratio is "1 (100%)" or more (Yes in S1450), the washing machine 1 fully operates the driving motor 80.

The controller 210 of the washing machine 1 supplies the whole power supplied from the external power supply PS to the driving motor 80. In detail, the controller 210 can output a driving signal with the duty ratio of 1 (100%) to the motor driver 240.

As described above, when beginning the operating of the driving motor 80, the washing machine 1 can perform "the phase angle control" to gradually increase the torque output by the driving motor 80. As a result, the torque of the driving motor 80 gradually increases in such a way that the abrasion and noise caused by the impact between the boss protrusions 182 of the clutch boss 180 and the coupling protrusions 173 of the clutch coupling 170 are reduced.

In detail, when "the phase angle control" is not performed, noise of about 59.68 dB and vibration of 114.83 m/s2 occur from the clutch assembly 100. However, when "the phase angle control" is performed, noise of about 55.65 dB and vibration of 26.01 m/s2 occur from the clutch assembly 100.

As described above, the speed detector 230 performs a significant role to control the rotary speed of the rotating tub 30 during the spin-drying operation of the washing machine 1.

Hereinafter, a method of detecting a failure of the speed detector 230 will be described.

Figure 22:
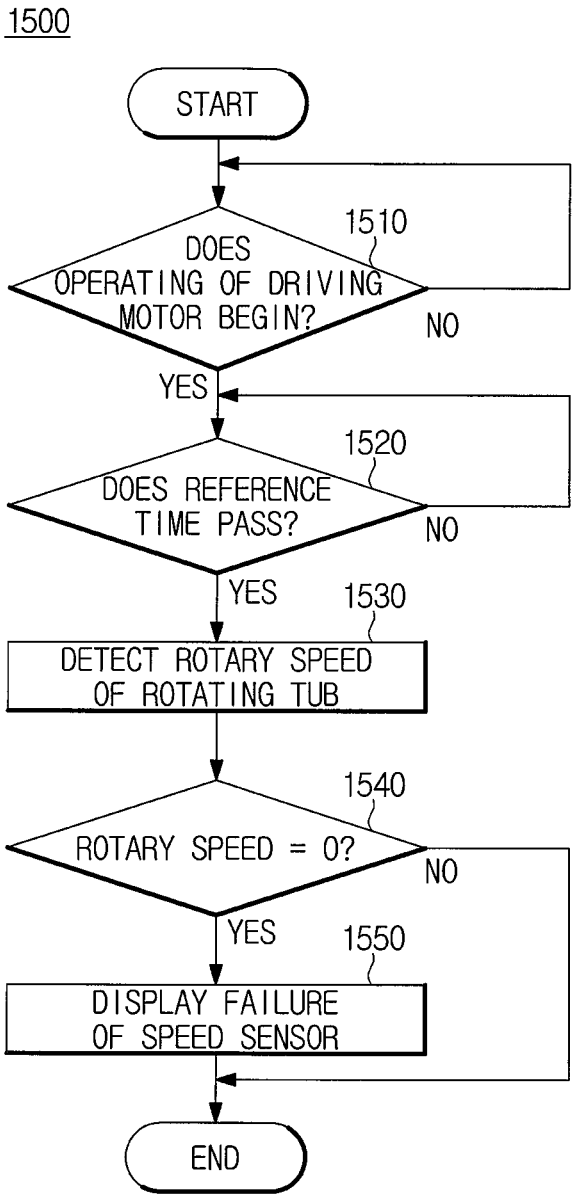
FIG. 22 is a flowchart illustrating an example of a method of detecting a failure of the speed detector by the washing machine in accordance with one embodiment of the present disclosure.

FIG. 22 is a flowchart illustrating an example of the method of detecting the failure of the speed detector 230 by the washing machine 1 in accordance with one embodiment of the present disclosure.

Referring to FIG. 22, the washing machine 1 determines whether to operate the driving motor 80 (S1510).

The controller 210 of the washing machine 1 can operate the driving motor 80 in various cases.

For example, when the spin-drying operation of the washing machine 1, which includes the intermittent spin-drying, begins, the controller 210 can operate the driving motor 80. Also, when the rotary speed of the rotating tub 30 is smaller than the difference between the target speed and the allowable error during the spin-drying operation, the controller 210 can operate the driving motor 80.

When it is not determined to operate the driving motor 80 (No in S1510), the washing machine 1 continues an existing operation.

Also, when it is determined to operate the driving motor 80 (Yes in S1510), the washing machine 1 determines whether a reference time passes after the operating of the driving motor 80 (S1520).

The controller 210 of the washing machine 1 can count a time which passes after the operating of the driving motor 80 and can compare the time which passes after the operating of the driving motor 80 with the reference time.

When it is not determined that the reference time passes after the operating of the driving motor 80 (No in S1520), the washing machine 1 continues the operating of the driving motor 80.

Also, when it is determined that the reference time passes after the operating of the driving motor 80 (Yes in S1520), the washing machine 1 detects the rotary speed of the rotating tub 30 (S1530).

The controller 210 of the washing machine 1 detects rotary speeds of the clutch assembly 100 and the rotating tub 30 based on an electric signal output by the speed detector 230.

As described above, in the spin-drying mode of the clutch assembly 100, the clutch assembly 100 transfers the torque provided from the driving motor 80 to the rotating tub 30 and the pulsator 40 as it is. Accordingly, the controller 210 can detect the rotary speed of the clutch assembly 100 using the speed detector 230 to detect the rotary speed of the rotating tub 30.

After that, the washing machine 1 determines whether the rotary speed of the rotating tub 30 is "0" (S1540).

The controller 210 of the washing machine 1 can detect the rotary speed of the rotating tub 30 based on the electric signal output by the speed detector 230 and can compare the detected rotary speed with "0".

When the rotary speed of the rotating tub 30 is not "0" (No in S1540), the washing machine 1 determines as a normal operation.

Also, when the rotary speed of the rotating tub 30 is "0" (Yes in S1540), the washing machine 1 displays a failure of the speed sensor 233 (S1550).

After operating the driving motor 80, when it is not determined that the rotating tub 30 rotates, the controller 210 of the washing machine 1 can determine as a failure of the driving motor 80 or the speed detector 230.

Here, since the washing machine 1 includes an additional protection circuit for detecting the failure of the driving motor 80, when the rotating of the rotating tub 30 is not detected, the controller 210 can determine as the failure of the speed sensor 233.

Accordingly, the controller 210 displays the failure of the speed sensor 233 to the user through the user interface 220.

As described above, when the rotating of the rotating tub 30 is not detected after operating the driving motor 80, the washing machine 1 can determine the failure of the speed sensor 233.

Figure 23:
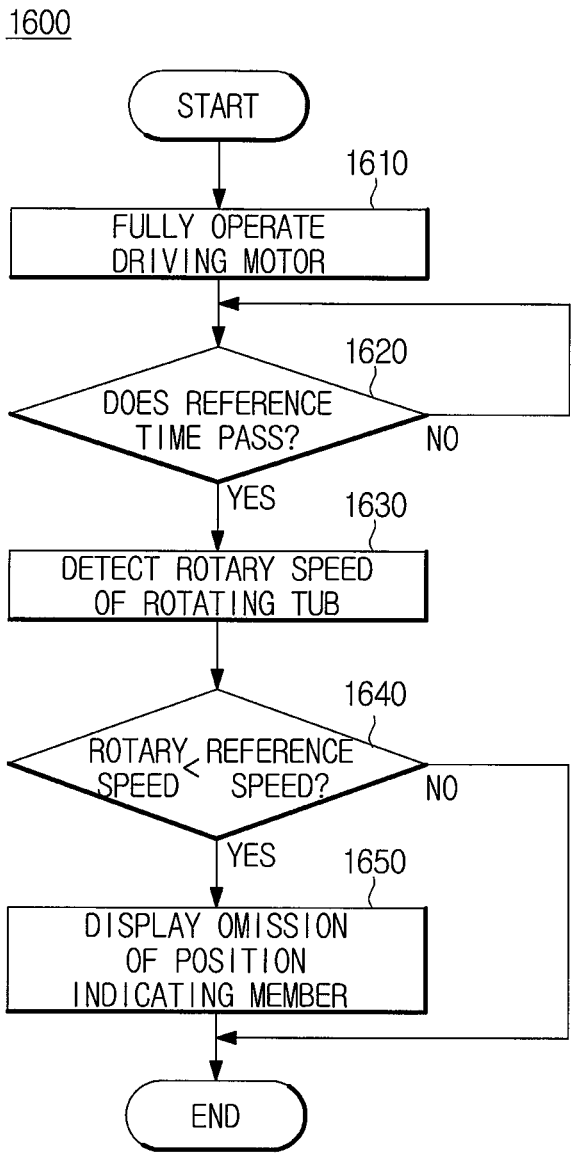
FIG. 23 is a flowchart illustrating another example of the method of detecting the failure of the speed detector by the washing machine in accordance with one embodiment of the present disclosure.

FIG. 23 is a flowchart illustrating another example of the method of detecting the failure of the speed detector 230 by the washing machine 1 in accordance with one embodiment of the present disclosure.

Referring to FIG. 23, the washing machine 1 fully operates the driving motor 80 (S1610).

To fully operate the driving motor 80, the controller 210 of the washing machine 1 can supply the whole power supplied from the external power supply PS to the driving motor 80. In detail, the controller 210 can output the driving signal for turning on the driving switch unit 241 to the motor driver 240.

After that, the washing machine 1 determines whether a reference time passes after the operating of the driving motor 80 (S1620).

The controller 210 of the washing machine 1 can count a time which passes after the operating of the driving motor 80 and can compare the time which passes after the operating of the driving motor 80 with the reference time.

When it is not determined that the reference time passes after the operating of the driving motor 80 (No in S1620), the washing machine 1 continues the operating of the driving motor 80.

Also, when it is determined that the reference time passes after the operating of the driving motor 80 (Yes in S1620), the washing machine 1 detects the rotary speed of the rotating tub 30 (S1630).

The controller 210 of the washing machine 1 detects rotary speeds of the clutch assembly 100 and the rotating tub 30 based on an electric signal output by the speed detector 230.

As described above, in the spin-drying mode of the clutch assembly 100, the clutch assembly 100 transfers the torque provided from the driving motor 80 to the rotating tub 30 and the pulsator 40 as it is. Accordingly, the controller 210 can detect the rotary speed of the clutch assembly 100 using the speed detector 230 to detect the rotary speed of the rotating tub 30.

After that, the washing machine 1 determines whether the rotary speed of the rotating tub 30 is smaller than a reference speed (S1640).

The controller 210 of the washing machine 1 can detect the rotary speed of the rotating tub 30 based on the electric signal output by the speed detector 230 and can compare the detected rotary speed with the reference speed.

Here, the reference speed can be set as a rotary speed smaller than a maximum rotary speed of the rotating tub 30. For example, when the maximum rotary speed of the rotating tub 30 is about 710 rpm, the reference speed can be set as about 650 rpm.

When the rotary speed of the rotating tub 30 is not smaller than the reference speed (No in S1640), the washing machine 1 determines as a normal operation.

Also, when the rotary speed of the rotating tub 30 is smaller than the reference speed (Yes in S1640), the washing machine 1 displays the omission of position indicating member 231 (S1650).

When the rotary speed of the rotating tub 30 is smaller than the reference speed even though the driving motor 80 is fully operated, the controller 210 can determine as the omission of the position indicating member 231.

In addition, the controller 210 can determine the number of the omitted position indicating members 231 depending on the rotary speed of the rotating tub 30. The determining of the number of the omitted position indicating members 231 depending on the rotary speed of the rotating tub 30 will be described below in detail.

As described above, when the rotating of the rotating tub 30 does not arrive at the reference speed after fully operating the driving motor 80, the washing machine 1 can determine the omission of the position indicating member 231.

FIGS. 24 to 29 illustrate a relationship between the omission of the position indicating members 231 and the rotary speed detected by the speed sensor 233 included in the washing machine 1 in accordance with one embodiment of the present disclosure.

As described above, the washing machine 1 can determine the number of the omitted position indicating members 231 depending on the rotary speed of the rotating tub 30.

The rotary speed of the rotating tub 30 can vary according to various factors. For example, the rotary speed of the rotating tub 30 can vary according to a level and a frequency of an input voltage supplied to the driving motor 80 and an amount of laundry contained in the rotating tub 30.

Hereinafter, for understanding, it is assumed that a voltage of 60 Hz and 120 V is supplied from the external power supply PS and the input voltage supplied from the external power supply PS has an error of about 15%. Also, it is assumed that the rotating tub 30 contains a load of 500 g. It is also assumed that the speed detector 230 includes the six position indicating members 231*a*, 231*b*, 231*c*, 231*d*, 231*e*, and 231*f* described above as shown in FIG. 7A.

Figure 24:
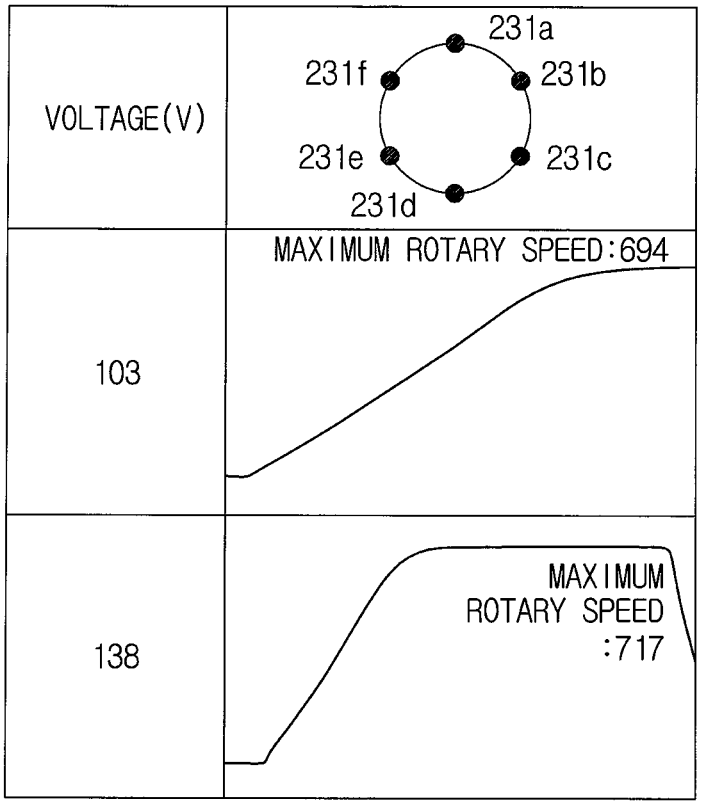
FIGS. 24 to 29 illustrate a relationship between the omission of a position display member and a rotary speed detected by a speed sensor included in the washing machine in accordance with one embodiment of the present disclosure.

Referring to FIG. 24, when all the six position indicating members 231*a*, 231*b*, 231*c*, 231*d*, 231*e*, and 231*f* are attached, a maximum rotary speed detected by the speed detector 230 is about 710 rpm. According to an experiment, the maximum rotary speed of the rotating tub 30 is about 694 rpm when the input voltage is 103 V and is about 717 rpm when the input voltage is 138 V.

Figure 25:
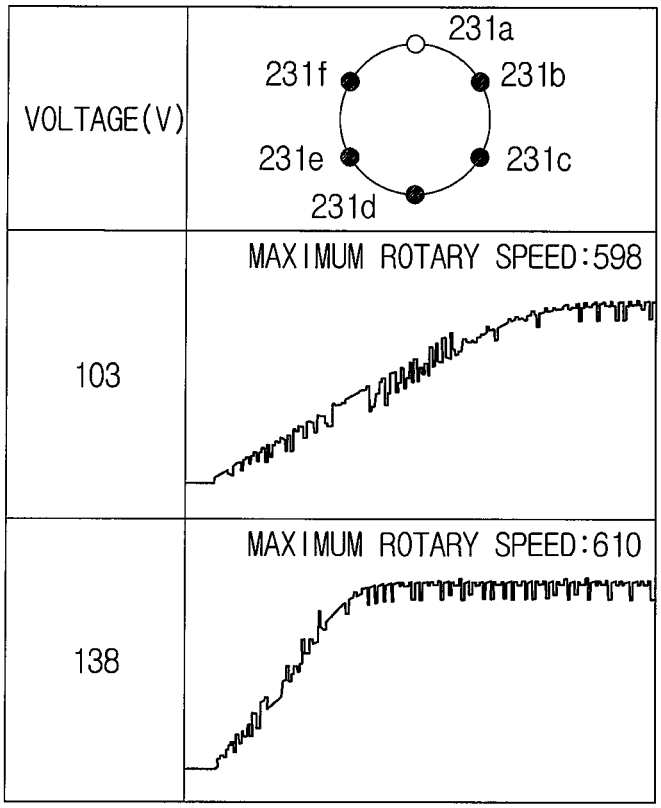

Referring to FIG. 25, when one position indicating member 231*a* is omitted, a maximum rotary speed detected by the speed detector 230 is about 605 rpm. According to an experiment, the maximum rotary speed detected by the speed detector 230 is about 598 rpm when the input voltage is 103 V and is about 610 rpm when the input voltage is 138 V.

When the two position indicating members 231 are omitted, a maximum rotary speed of the rotating tub 30, detected by the speed detector 230, can vary according to positions of the omitted position indicating members 231.

Figure 26:
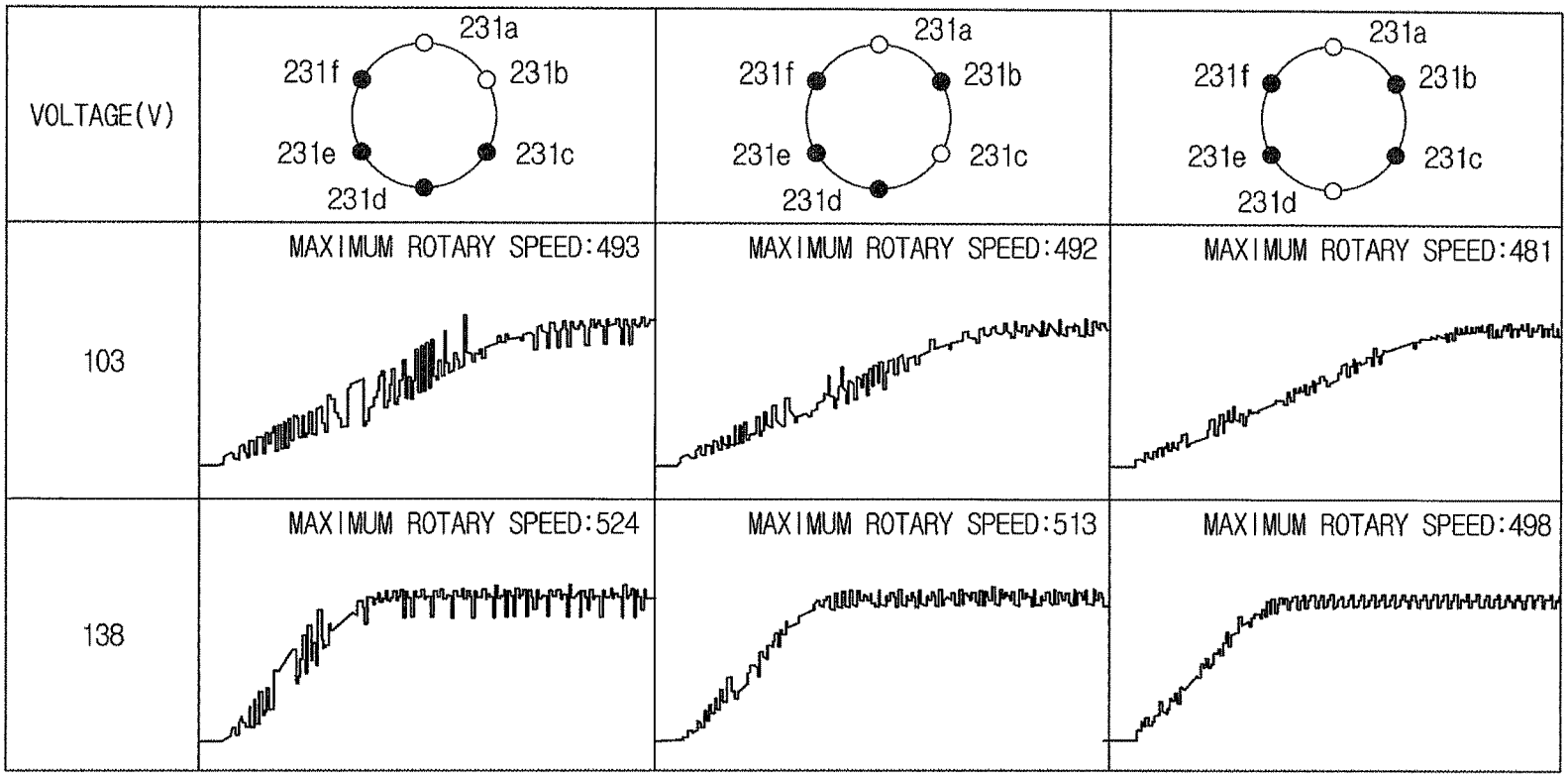

Referring to FIG. 26, when the adjacent position indicating members 231*a* and 231*b* are omitted, a maximum rotary speed detected by the speed detector 230 is about 510 rpm. According to an experiment, the maximum rotary speed detected by the speed detector 230 is about 493 rpm when the input voltage is 103 V and is about 524 rpm when the input voltage is 138 V.

Also, when the position indicating members 231*a* and 231*c* located on both sides of one position indicating member 231*b* are omitted, a maximum rotary speed detected by the speed detector 230 is about 502 rpm. According to an experiment, the maximum rotary speed detected by the speed detector 230 is about 493 rpm when the input voltage is 103 V and is about 513 rpm when the input voltage is 138 V.

Also, when the position indicating members 231*a* and 231*d* which face each other are omitted, a maximum rotary speed detected by the speed detector 230 is about 490 rpm. According to an experiment, the maximum rotary speed detected by the speed detector 230 is about 481 rpm when the input voltage is 103 V and is about 498 rpm when the input voltage is 138 V.

As described above, when the two position indicating members 231 are omitted, the maximum rotary speed of the rotating tub 30, detected by the speed detector 230, can be about 490 rpm to 510 rpm depending on the positions of the omitted position indicating members 231.

When the three position indicating members 231 are omitted, the maximum rotary speed of the rotating tub 30, detected by the speed detector 230, can vary according to positions of the omitted position indicating members 231.

Figure 27:
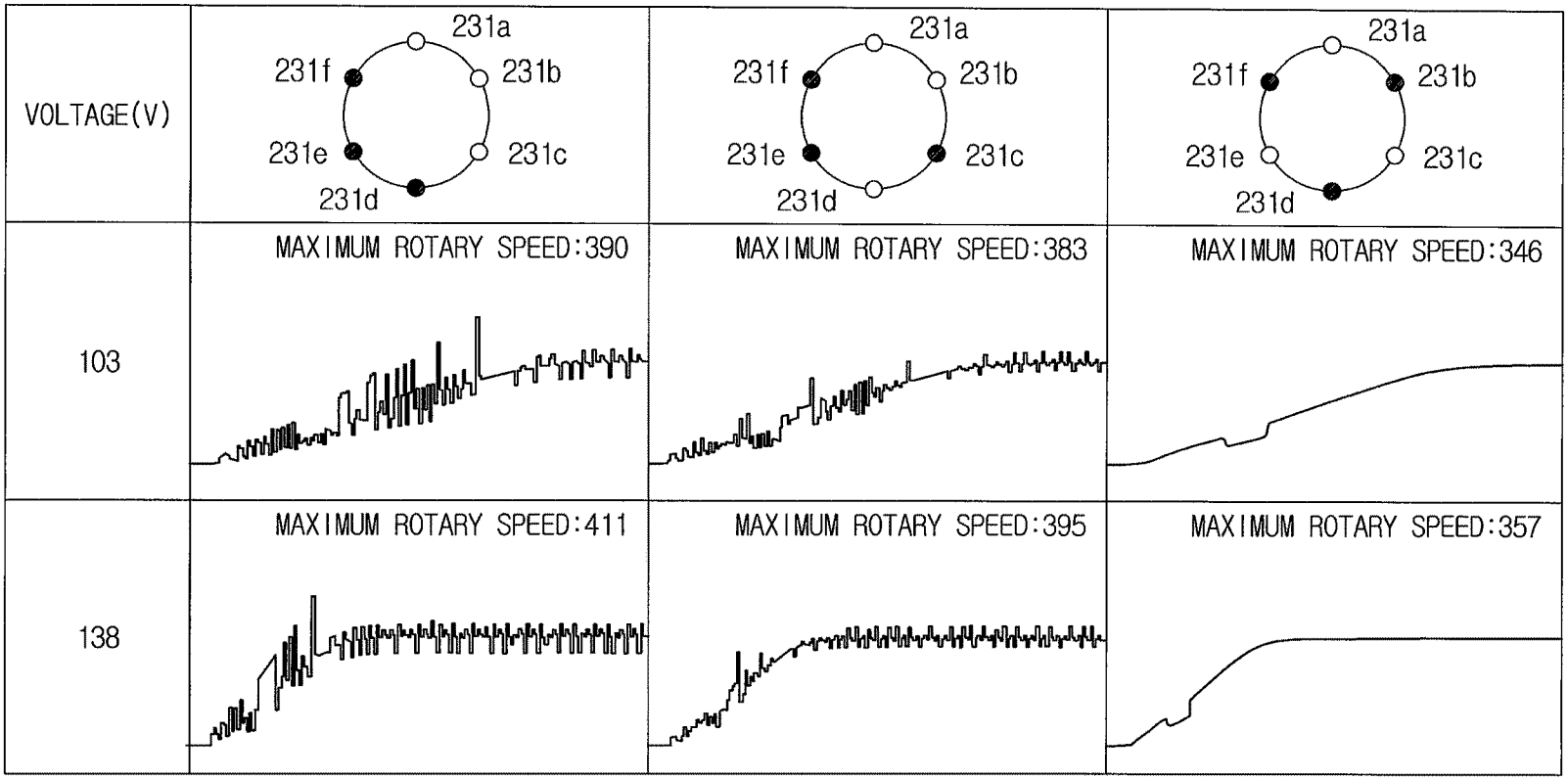

Referring to FIG. 27, when the three adjacent position indicating members 231*a*, 231*b*, and 231*c* are omitted, a maximum rotary speed detected by the speed detector 230 is about 400 rpm. According to an experiment, the maximum rotary speed detected by the speed detector 230 is about 390 rpm when the input voltage is 103 V and is about 411 rpm when the input voltage is 138 V.

Also, when the adjacent position indicating members 231*a* and 231*b* and the position indicating member 231*d* not adjacent thereto are omitted, a maximum rotary speed detected by the speed detector 230 is about 390 rpm. According to an experiment, the maximum rotary speed detected by the speed detector 230 is about 383 rpm when the input voltage is 103 V and is about 395 rpm when the input voltage is 138 V.

Also, when the three position indicating members 231*a*, 231*c*, and 231*e*, which are not adjacent to one another, are omitted, a maximum rotary speed detected by the speed detector 230 is about 350 rpm. According to an experiment, the maximum rotary speed detected by the speed detector 230 is about 346 rpm when the input voltage is 103 V and is about 357 rpm when the input voltage is 138 V.

As described above, when the three position indicating members 231 are omitted, the maximum rotary speed of the rotating tub 30, detected by the speed detector 230, can be about 350 rpm to 400 rpm depending on the positions of the omitted position indicating members 231.

When the four position indicating members 231 are omitted, the maximum rotary speed of the rotating tub 30, detected by the speed detector 230, can vary according to positions of the omitted position indicating members 231.

Figure 28:
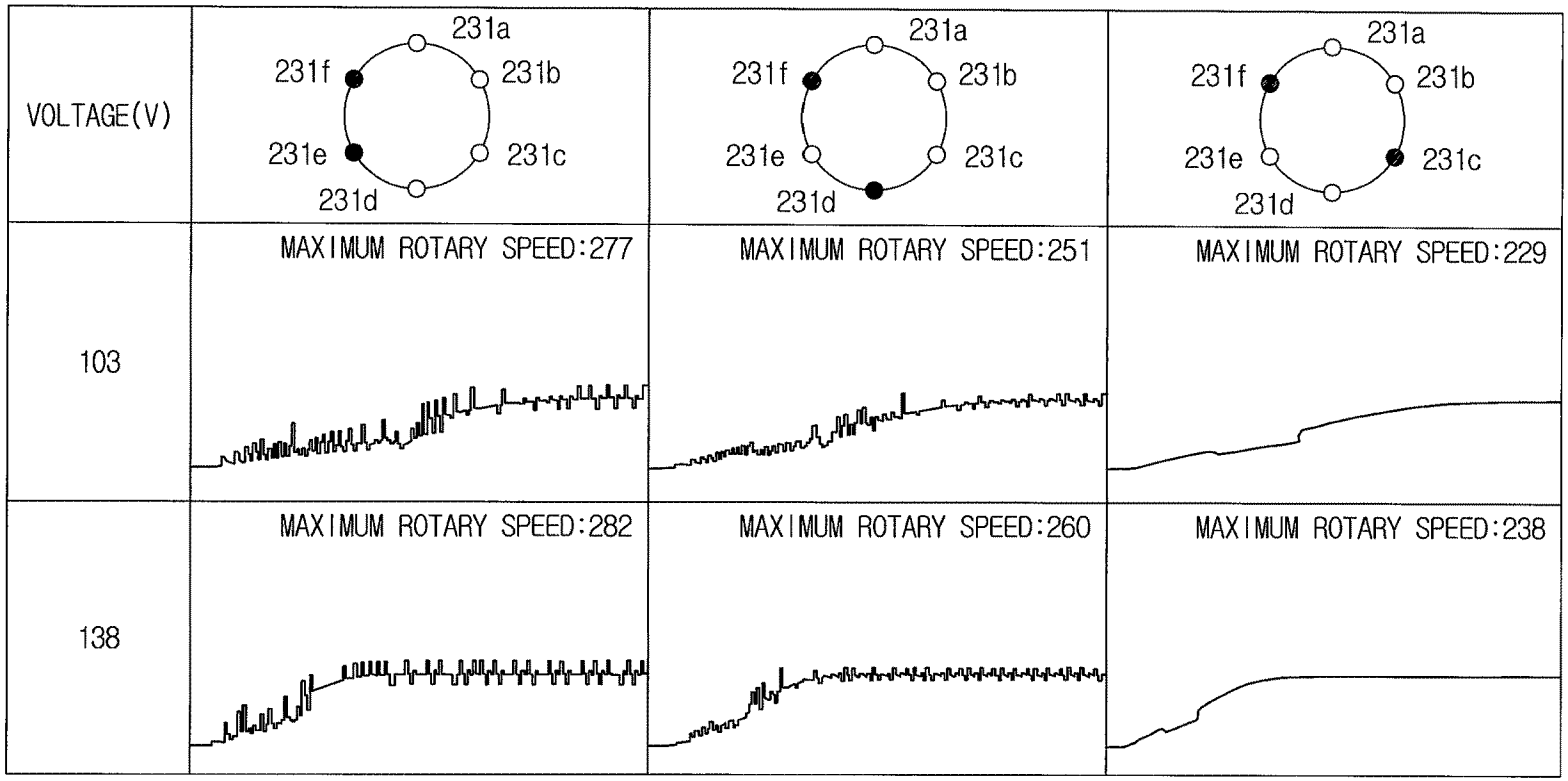

Referring to FIG. 28, when the four adjacent position indicating members 231*a*, 231*b*, 231*c*, and 231*d* are omitted, a maximum rotary speed detected by the speed detector 230 is about 280 rpm. According to an experiment, the maximum rotary speed detected by the speed detector 230 is about 277 rpm when the input voltage is 103 V and is about 282 rpm when the input voltage is 138 V.

Also, when the three adjacent position indicating members 231*a*, 231*b*, and 231*c* and the position indicating member 231*d* not adjacent thereto are omitted, a maximum rotary speed detected by the speed detector 230 is about 390 rpm. According to an experiment, the maximum rotary speed detected by the speed detector 230 is about 251 rpm when the input voltage is 103 V and is about 260 rpm when the input voltage is 138 V.

Also, when two pair of the position indicating members 231*a* and 231*b* and 231*d* and 231*e* which face one another, are omitted, a maximum rotary speed detected by the speed detector 230 is about 235 rpm. According to an experiment, the maximum rotary speed detected by the speed detector 230 is about 229 rpm when the input voltage is 103 V and is about 238 rpm when the input voltage is 138 V.

As described above, when the four position indicating members 231 are omitted, the maximum rotary speed of the rotating tub 30, detected by the speed detector 230, can be about 235 rpm to 280 rpm depending on the positions of the omitted position indicating members 231.

Figure 29:
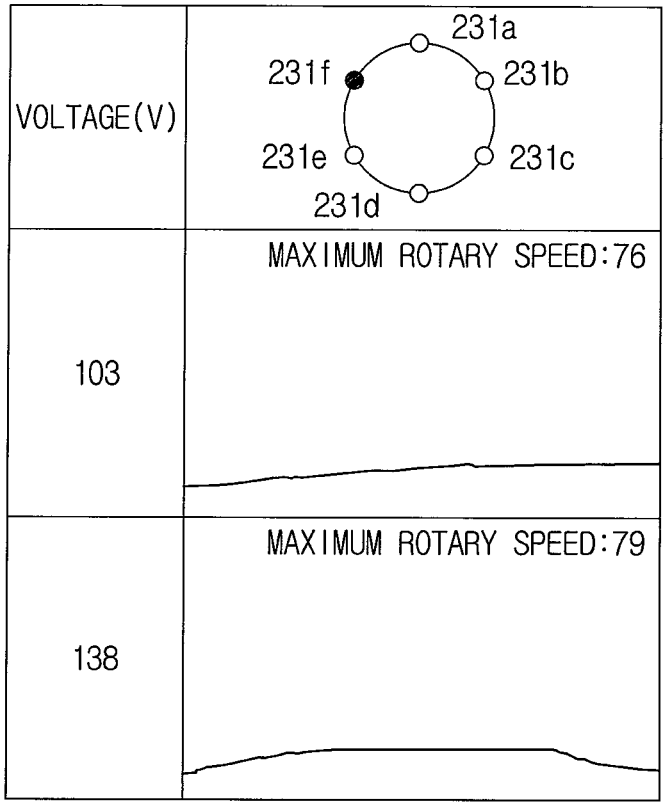

Referring to FIG. 29, when the five position indicating members 231*a*, 231*b*, 231*c*, 231*d*, and 231*e* are omitted, a maximum rotary speed detected by the speed detector 230 is about 78 rpm. According to an experiment, the maximum rotary speed detected by the speed detector 230 is about 76 rpm when the input voltage is 103 V and is about 79 rpm when the input voltage is 138 V.

In brief, when the position indicating members 231 are not omitted when the driving motor 80 is fully operate, the maximum rotary speed detected by the speed detector 230 is about 710 rpm. When one of the position indicating members 231 is omitted, the maximum rotary speed detected by the speed detector 230 is about 605 rpm.

Also, when the two position indicating members 231 are omitted, the maximum rotary speed of the rotating tub 30, detected by the speed detector 230, is about 490 rpm to 510 rpm. When the three position indicating members 231 are omitted, the maximum rotary speed of the rotating tub 30, detected by the speed detector 230, is about 350 rpm to 400 rpm.

Also, when the four position indicating members 231 are omitted, the maximum rotary speed of the rotating tub 30, detected by the speed detector 230, is about 235 rpm to 280 rpm. When the five position indicating members 231 are omitted, the maximum rotary speed of the rotating tub 30, detected by the speed detector 230, is about 78 rpm.

As described above, since the maximum rotary speed detected by the speed detector 230 varies depending on the number of the omitted position indicating members 231, a plurality of reference speeds can be set and the number of the omitted position indicating members 231 can be determined.

As is apparent from the above description, a washing machine in accordance with one embodiment of the present disclosure includes a non-control type motor while minimizing a resonance phenomenon during a spin-drying operation.

Also, a washing machine in accordance with another embodiment of the present disclosure includes a clutch assembly while minimizing noise and vibration which occur while a driving motor operates.

Also, a washing machine in accordance with still another embodiment of the present disclosure includes a speed detector while detecting a failure of the speed detector.

Although the present disclosure has been described with an exemplary embodiment, various changes and modifications can be suggested to one skilled in the art. It is intended that the present disclosure encompass such changes and modifications as fall within the scope of the appended claims.

What is claimed is:

1. A washing machine comprising:

an alternating current (AC) motor configured to generate torque;

a clutch assembly configured to selectively transfer the torque to a rotating tub and a pulsator;

a speed detector configured to detect a rotary speed of the clutch assembly; and a controller configured to repetitively perform operating and stopping the operation of the AC motor based on a predetermined target speed and the rotary speed of the clutch assembly during a spin-drying operation, wherein the controller is configured to gradually increase the torque of the AC motor while operating the AC motor during the spin-drying operation.

2. The washing machine of claim 1, wherein the controller is configured to control a phase angle of AC power supplied from an external power supply and to supply the AC power controlled in phase angle to the AC motor while operating the AC motor.

3. The washing machine of claim 2, wherein the controller is configured to supply at least a part of one cycle of an AC current supplied from the external power supply to the AC motor while operating the AC motor.

4. The washing machine of claim 3, further comprising a driving switch unit configured to conduct or cut off the power supplied from the external power supply to the AC motor.

5. The washing machine of claim 4, wherein the controller is configured to turn on the driving switch unit for a conduction time in one cycle of the AC power supplied from the external power supply while operating the AC motor.

6. The washing machine of claim 5, wherein the controller is configured to gradually increase the conduction time while operating the AC motor.

7. The washing machine of claim 1, wherein the controller is configured to stop the operating of the AC motor when the rotary speed is greater than a sum of the target speed and an allowable error while operating the AC motor.

8. The washing machine of claim 1, wherein the controller is configured to begin the operating of the AC motor when the rotary speed is smaller than a difference between the target speed and an allowable error while stopping the operating of the AC motor.

9. The washing machine of claim 1, wherein the target speed varies according to a time in which the spin-drying operation is performed.

10. The washing machine of claim 1, wherein the speed detector comprises:

a position indicating member configured to rotate together with the clutch assembly; and a speed sensor configured to detect the position indicating member and output an electric signal corresponding to whether the position indicating member is detected.

11. The washing machine of claim 10, wherein the controller is configured to warn a user of a failure of the speed sensor when the rotary speed is "0" after the AC motor is operated.

12. The washing machine of claim 10, wherein the controller is configured to warn a user of omission of the position indicating member when the rotary speed is smaller than a predetermined reference speed after the AC motor is fully operated.

13. A method of controlling a washing machine, comprising:

operating an AC motor that generates torque during a spin-drying operation;

detecting a rotary speed of a clutch assembly that transfers the torque to a rotating tub and a pulsator; and repetitively performing operating and stopping the operating of the AC motor based on a predetermined target speed and the rotary speed of the clutch assembly during the spin-drying operation, wherein the operating of the AC motor comprises gradually increasing the torque of the AC motor during the spin-drying operation.

14. The method of claim 13, wherein the gradually increasing of the torque of the AC motor comprises:

controlling a phase angle of AC power supplied from an external power supply; and supplying the AC power controlled in phase angle to the AC motor.

15. The method of claim 14, wherein the supplying of the AC power controlled in phase angle to the AC motor comprises supplying at least a part of one cycle of an AC current supplied from the external power supply to the AC motor.

16. The method of claim 13, wherein the repetitively performing the operating and stopping of the operating of the AC motor comprises stopping the operating of the AC motor when the rotary speed is greater than a sum of the target speed and an allowable error while operating the AC motor.

17. The method of claim 13, wherein the repetitively performing the operating and stopping of the operating of the AC motor comprises beginning the operating of the AC motor when the rotary speed is smaller than a difference between the target speed and an allowable error while stopping the operating of the AC motor.

18. The method of claim 13, wherein the target speed varies according to a time in which the spin-drying operation is performed.

19. The method of claim 13, further comprising warning a user of a failure of a speed sensor which detects the rotary speed of the clutch assembly when the rotary speed is "0" after the AC motor is operated.

20. The method of claim 13, further comprising warning a user of a failure of a speed sensor which detects the rotary speed of the clutch assembly when the rotary speed is smaller than a predetermined reference speed after the AC motor is fully operated.

* * * * *